US008172391B2

(12) United States Patent
Fukui

(10) Patent No.: US 8,172,391 B2
(45) Date of Patent: May 8, 2012

(54) IMAGE FORMING APPARATUS

(75) Inventor: Takashi Fukui, Kanagawa-ken (JP)

(73) Assignee: FujiFilm Corporation, Tokyo (JP)

( * ) Notice: Subject to any disclaimer, the term of this patent is extended or adjusted under 35 U.S.C. 154(b) by 427 days.

(21) Appl. No.: 12/468,310

(22) Filed: May 19, 2009

(65) Prior Publication Data

US 2009/0290008 A1 Nov. 26, 2009

(30) Foreign Application Priority Data

May 20, 2008 (JP) ..... 2008-132400

(51) Int. Cl.
*B41J 2/01* (2006.01)

(52) U.S. Cl. ..... 347/104; 101/118

(58) Field of Classification Search ..... 347/101, 347/103, 104; 101/118
See application file for complete search history.

(56) References Cited

U.S. PATENT DOCUMENTS

| | | | | |
|---|---|---|---|---|
| 3,829,208 | A * | 8/1974 | van Meijel et al. | 399/161 |
| 5,389,961 | A * | 2/1995 | Takagi | 347/29 |
| 5,576,754 | A * | 11/1996 | Korem | 347/262 |
| 5,931,589 | A * | 8/1999 | Kamano et al. | 400/629 |
| 6,204,871 | B1 * | 3/2001 | Keller et al. | 347/139 |
| 6,283,652 | B1 * | 9/2001 | Sasaki et al. | 400/208 |
| 6,375,319 | B1 | 4/2002 | Kamano et al. | |
| 6,525,754 | B2 * | 2/2003 | Landolt | 347/139 |
| 7,909,454 | B2 * | 3/2011 | Koto et al. | 347/104 |

FOREIGN PATENT DOCUMENTS

JP 10-175337 A 6/1998

* cited by examiner

*Primary Examiner* — Charlie Peng
(74) *Attorney, Agent, or Firm* — Birch, Stewart, Kolasch & Birch, LLP

(57) ABSTRACT

The image forming apparatus includes: a holding and conveyance device which has a round cylindrical shape and is rotatable about a rotational axis, the holding and conveyance device conveying a recording medium in a prescribed conveyance direction by rotating about the rotational axis while holding the recording medium on an outer circumferential surface of the holding and conveyance device, the holding and conveyance device having a recess section arranged in a direction parallel to the rotational axis at a prescribed position on the outer circumferential surface of the holding and conveyance device; an end portion holding member which is arranged in the recess section and has an end portion holding surface by which at least one of a leading end portion and a trailing end portion of the recording medium held on the outer circumferential surface is held to an inner side relative to an image forming surface of the recording medium held on the outer circumferential surface; and an image forming device which forms an image on the recording medium held on the holding and conveyance device, wherein: a radius of curvature of the end portion holding surface is smaller than a radius of the outer circumferential surface; and a tangential direction of the end portion holding surface at an end of the end portion holding surface on a side of the outer circumferential surface is substantially a same with a tangential direction of the outer circumferential surface at an end on a side of the end portion holding surface.

8 Claims, 18 Drawing Sheets

IMAGE FORMING APPARATUS

BACKGROUND OF THE INVENTION

1. Field of the Invention

The present invention relates to an image forming apparatus, and more particularly to technology for fixing and holding a recording medium and technology for conveying the recording medium in an image recording device for forming an image on the recording medium.

2. Description of the Related Art

As a general image forming apparatus, it is suitable to use an inkjet recording apparatus, which forms a desired image on a recording medium by ejecting and depositing a plurality of colors of inks onto the recording medium from a plurality of nozzles provided in an inkjet head. In the inkjet recording apparatus, the recording medium is held and conveyed by, for example, a drum conveyance method or a belt conveyance method. In the drum conveyance method, the recording medium is held on the outer circumferential surface of a conveyance member having a drum shape, and the recording medium is conveyed with rotation of the drum. In the belt conveyance method, the recording medium is held on the surface of an endless belt that is wrapped about a plurality of rollers, and the recording medium is conveyed with rotation of the rollers. As the method of holding the recording medium on the conveyance member, one of various methods is used appropriately in accordance with the composition of the apparatus: such as an air suction method, in which the recording medium is fixed and held by a suction pressure (negative pressure) applied through suction holes arranged in the surface of the conveyance member on which the recording medium is held from the inner side of the conveyance member; an electrostatic attraction method, which uses static electricity; a method which uses a mechanical holding member; and the like.

In the inkjet recording apparatus, in order to form images of high definition it is necessary to bring the inkjet head and the recording medium as close together as possible during image formation. On the other hand, if the inkjet head and the recording medium make contact with each other, then the image formed on the recording medium may be degraded and the inkjet head may be damaged. Hence, an extremely small working distance of several millimeters or less is allowed between the inkjet head and the recording medium, with the object of avoiding contact between the inkjet head and the recording medium.

Japanese Patent Application Publication No. 10-175337 discloses an inkjet printer in which a print medium which is electrostatically charged by a charging roller is then held on the outer circumferential surface of a drum by an electrostatic force of attraction. The drum is rotatable about a prescribed axis, and printing is carried out by depositing ink onto the print medium while the drum rotates. This inkjet printer adopts a composition in which the leading end portion of the print medium is held by applying a mechanical gripping force by means of a gripping hook at a position to the inside of the outer circumferential surface of the drum. The gripping hook is arranged in the center of a recess section formed on the outer circumferential surface of the drum so as to prevent the gripping hook from projecting beyond the outer circumferential surface of the drum and interfering with the nozzle unit (inkjet head).

However, if a recording medium is held in a bent state whereby the leading end portion of the recording medium is held to the inside of the outer circumferential surface of the drum, as in the inkjet printer described in Japanese Patent Application Publication No. 10-175337, the leading end portion of the recording medium (the vicinity of the bent portion of the recording medium) may lift up above the drum.

FIG. 22 shows a schematic view of the lifting up of a recording medium in the drum conveyance method described above. As shown in FIG. 22, when a leading end portion 614A of a recording medium 614 held on an outer circumferential surface 606 of a conveyance drum 600 is held by means of a gripper 616 to the inside of the outer circumferential surface 606 of the conveyance drum 600, then a bent portion 614B of the recording medium 614 floats up from the outer circumferential surface 606 of the conveyance drum 600.

If lifting up of the recording medium occurs in this way, then the portion where the image cannot be satisfactorily formed at the leading end side of the recording medium becomes larger, and it is necessary to dispose the inkjet head at a distance of separation from the recording medium which is greater than the amount of lifting up of the recording medium, and this is disadvantageous in terms of high-quality image formation.

SUMMARY OF THE INVENTION

The present invention has been contrived in view of these circumstances, an object thereof being to provide an image forming apparatus which achieves desirable image formation by preventing lifting up of the recording medium when the leading end portion of the ejection receiving medium is held to the inner side of the image forming surface of the recording medium.

In order to attain the aforementioned object, the present invention is directed to an image forming apparatus, comprising: a holding and conveyance device which has a round cylindrical shape and is rotatable about a rotational axis, the holding and conveyance device conveying a recording medium in a prescribed conveyance direction by rotating about the rotational axis while holding the recording medium on an outer circumferential surface of the holding and conveyance device, the holding and conveyance device having a recess section arranged in a direction parallel to the rotational axis at a prescribed position on the outer circumferential surface of the holding and conveyance device; an end portion holding member which is arranged in the recess section and has an end portion holding surface by which at least one of a leading end portion and a trailing end portion of the recording medium held on the outer circumferential surface is held to an inner side relative to an image forming surface of the recording medium held on the outer circumferential surface; and an image forming device which forms an image on the recording medium held on the holding and conveyance device, wherein: a radius of curvature of the end portion holding surface is smaller than a radius of the outer circumferential surface; and a tangential direction of the end portion holding surface at an end of the end portion holding surface on a side of the outer circumferential surface is substantially a same with a tangential direction of the outer circumferential surface at an end on a side of the end portion holding surface.

According to this aspect of the present invention, in the conveyance of the recording medium using the holding and conveyance device having the drum shape, when holding the leading end portion or the trailing end portion of the recording medium (hereinafter, simply called "end portion") to the inner side of the outer circumferential surface of the conveyance drum, since the end portion of the recording medium is held on an end portion holding surface having a radius of curvature smaller than the radius of the outer circumferential surface, in which the tangential direction on the side by the outer circumferential surface is substantially the same with the tangential direction of the outer circumferential surface, then it is possible effectively to reduce the lifting up of the recording medium in the vicinity of the end portion of the recording medium (and in particular, in the vicinity of the boundary between the outer circumferential surface of the conveyance device and the recess section where the end portion holding member is arranged), and the end portion of the recording medium is prevented from curling or producing a crease by folding. Consequently, lifting up of the recording medium and contact between the recording medium and the image forming device due to lifting, folding or a crease is prevented, and therefore desirable image formation is achieved, in addition to which breaking of the image forming device is prevented.

The recording medium includes sheet-shaped media of various types, such as paper, resin sheets, metal sheets, and the like. The form of the recording medium may be a long continuous sheet or cut sheet which is cut to a prescribed size.

To give one example of an image forming device, there is a mode which includes a liquid ejection head that ejects liquid, such as ink, onto a recording medium (an inkjet head), or a mode including a laser recording head that applies a laser beam to the recording medium.

In the mode including the inkjet head as the image forming device, a mode where a plurality of types of liquid are mixed on the recording medium to form an image on the recording medium may be employed. Possible modes of the plurality of liquids are a mode which comprises an ink containing coloring material and a treatment liquid having a function of aggregating or insolubilizing the coloring material in the ink, and a mode which comprises, in addition to ink and treatment liquid, a liquid having a permeation suppression function which suppresses the permeation of the ink and treatment liquid into the recording medium.

A desirable mode is one which comprises a fixing processing device which carries out a fixing process on the image on the recording medium after forming an image on the recording medium. Specific examples of the fixing processing device are: a heat fixing process by a heating device, a pressure fixing process by a pressing device, a fixing process which combines the application of heat and pressure, and a process which applies curing energy by means of a curing energy deposition device after applying a transparent liquid which is cured by application of energy.

Preferably, an angular difference between the tangential direction of the end portion holding surface at the end of the end portion holding surface on the side of the outer circumferential surface and the tangential direction of the outer circumferential surface at the end on the side of the end portion holding surface is less than 5°.

It is more preferable that the tangential direction of the end portion holding surface at the end of the end portion holding surface on the side of the outer circumferential surface and the tangential direction of the outer circumferential surface at the end on the side of the end portion holding surface are the same.

Preferably, the image forming apparatus further comprises a gripping member which is arranged in the recess section and grips the recording medium against the end portion holding surface.

According to this aspect of the present invention, since the end portion of the recording medium is gripped by the gripping member, then it is possible to fix the end portion of the recording medium reliably, and hence the reliability of conveyance of the recording medium is improved.

It is also preferable that a plurality of griping members are provided in the direction of the axis of rotation of the holding conveyance device (the direction perpendicular to the direction of conveyance of the recording medium), and a plurality of positions of the end portion of the recording medium are gripped in the breadthways direction of the recording medium (the direction of the axis of rotation).

Preferably, the gripping member is disposed to an inner side relative to the image forming surface of the recording medium in a state where the at least one of the leading end portion and the trailing end portion of the recording medium is gripped.

According to this aspect of the present invention, it is possible to prevent deterioration of image quality and damage to the gripping member and image recording device caused by contact between the gripping member and the image forming device.

It is more preferable that the gripping member is positioned to the inner side of the outer circumferential surface of the holding and conveyance device in a state of gripping the recording medium.

Preferably, the end portion holding surface includes a curved surface section in connection with the end of the outer circumferential surface and a flat surface section in connection with an end of the curved surface section on a side opposite to the outer circumferential surface; and the gripping member is disposed at a position where the gripping member grips the at least one of the leading end portion and the trailing end portion of the recording medium onto the flat surface section.

According to this aspect of the present invention, since the end portion of the recording medium is gripped in the flat surface section and the recording medium and the gripping member make surface to surface contact, then it is possible to raise the holding force of the recording medium and the reliability of holding the recording medium is improved.

It is more preferable that the flat surface section is parallel to the tangential direction of the curved surface section at the boundary on the side of the curved surface section.

Preferably, the end portion holding surface includes a plurality of curved surface sections having radii of curvature different to each other; and each of the radii of curvature of the curved surface sections is smaller than the radius of the outer circumferential surface of the holding and conveyance device.

According to this aspect of the present invention, it is possible to grip the end portion of the recording medium at a position further to the inner side.

It is more preferable that the plurality of curved surface sections are arranged in order of decreasing radius of curvature, from the side of the outer circumferential surface (from the upstream side in terms of the conveyance direction of the recording medium). For example, if the plurality of curved surface sections have shapes in which the radius of curvature decreases sequentially from the outer circumferential surface side toward the inner side of the recess section, in other words, if the radius (radius of curvature) of the outer circumferential surface is taken as $R_d$ and if the end portion holding surface includes three curved surfaces having radii of curvature $R_1$, $R_2$ and $R_3$, and the curved surface having the radius of curvature $R_1$, the curved surface having the radius of curvature $R_2$ and the curved surface having the radius of curvature $R_3$ are formed in this sequence from the side of the outer circumferential surface, then the radii should have the relationship: $R_d>R_1>R_2>R_3$.

If the leading end portion of the recording medium is gripped and conveyed, then the relationship is $R_d>R_1>R_2>R_3$ from the upstream side in terms of the conveyance direction of the recording medium, and if the trailing end portion of the recording medium is gripped and conveyed, then the relationship is $R_d>R_1>R_2>R_3$ from the downstream side in terms of the conveyance direction of the recording medium.

Preferably, the radius of curvature of the end portion holding surface is not smaller than 50 mm.

According to this aspect of the present invention, by making the radius of curvature of the end portion holding surface 50 mm or greater (and less than the radius of curvature of the outer circumferential portion), it is possible effectively to suppress lifting up of the recording medium in the end portion of the recording medium (the held portion) and in the vicinity of the end portion.

In particular, if the thickness of the recording medium is not larger than 0.2 mm, then it is possible to determine the radius of the outer circumferential surface and the radius of curvature of the end portion holding surface, in such a manner that the upper limit value of the amount of lifting of the recording medium (the height of the image forming surface of the recording medium from the outer circumferential surface of the holding and conveyance device) is not larger than 1 mm.

Preferably, the holding and conveyance device has a suction structure which holds the recording medium on the outer circumferential surface by suction; and the image forming apparatus further comprises a pressure generating device which applies a suction pressure to the recording medium through the suctioning structure.

According to this aspect of the present invention, it is possible to fix the whole of the recording medium in tight contact with the outer circumferential surface of the holding and conveyance device. Furthermore, in a mode which includes a liquid ejection head which ejects liquid droplets onto a recording medium by an inkjet method, since static electricity is not used to fix the recording medium, then no electric field acts on the liquid droplets and therefore variation in the direction of flight of the liquid is suppressed and high-quality image formation can be achieved.

Preferably, the image forming apparatus further comprises a pressing device which presses the recording medium against the outer circumferential surface of the holding conveyance device.

According to this aspect of the present invention, it is possible further to suppress the lifting up of the end portion of the recording medium, which is desirable.

The pressing device may employ a mode having a pressing device which makes contact with the recording medium and presses the recording medium against the outer circumferential surface (a pressing member), and it may also employ a mode having an air blowing device which presses the recording medium indirectly by blowing an air flow from the side of the recording medium opposite to the holding and conveyance device.

It is preferable that the pressing device is arranged directly after the transfer section where the recording medium is transferred and received onto the holding and conveyance device.

Preferably, the image forming device includes a liquid ejection head having nozzles which eject liquid.

The liquid ejection head includes an inkjet head which ejects colored inks. It is preferable that a plurality of inkjet heads are provided respectively for the colors.

The liquid which can be used in the liquid ejection head is not limited to a colored ink, and the present invention may also be applied to liquids of various different types which can be ejected by an inkjet method, such as resin liquid, resist liquid, and various other types of treatment liquids.

According to the present invention, in the conveyance of the recording medium using the holding and conveyance device having the drum shape, when holding the leading end portion or the trailing end portion of the recording medium to the inner side of the outer circumferential surface of the conveyance drum, since the end portion of the recording medium is held on an end portion holding surface having a radius of curvature smaller than the radius of the outer circumferential surface, in which the tangential direction on the side by the outer circumferential surface is substantially the same with the tangential direction of the outer circumferential surface, then it is possible effectively to reduce the lifting up of the recording medium in the vicinity of the end portion of the recording medium (and in particular, in the vicinity of the boundary between the outer circumferential surface of the conveyance device and the recess section where the end portion holding member is arranged), and the end portion of the recording medium is prevented from curling or producing a crease by folding. Consequently, lifting up of the recording medium and contact between the recording medium and the image forming device due to lifting, folding or a crease is prevented, and therefore desirable image formation is achieved, in addition to which breaking of the image forming device is prevented.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Apparatus

Figure 1:
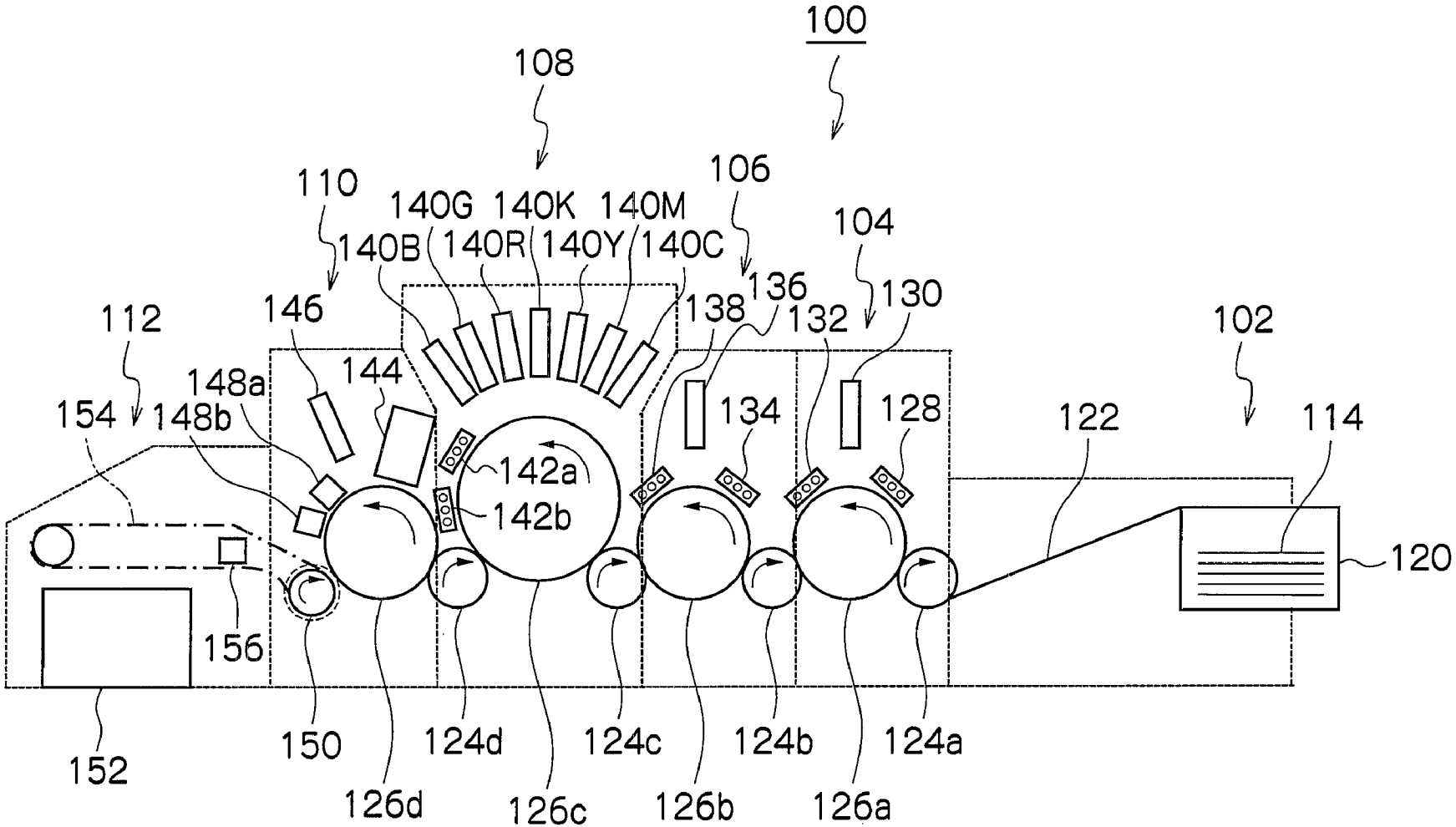
FIG. 1 is a general schematic drawing of an inkjet recording apparatus according to an embodiment of the present invention.

FIG. 1 is a general schematic drawing illustrating the general composition of an inkjet recording apparatus (image forming apparatus) 100 according to an embodiment of the present invention. The inkjet recording apparatus 100 shown in FIG. 1 is a single side machine, which is capable of printing only onto one surface of a recording medium 114. The inkjet recording apparatus 100 includes: a paper supply unit 102, which supplies the recording medium 114; a permeation suppression processing unit 104, which carries out permeation suppression processing on the recording medium 114; a treatment agent deposition unit 106, which deposits treatment agent onto the recording medium 114; a print unit 108, which forms an image by depositing the colored inks onto the recording medium 114; a transparent UV ink deposition unit 110, which deposits the transparent UV ink onto the recording medium 114; and a paper output unit 112, which conveys and outputs the recording medium 114 on which the image has been formed.

A paper supply platform 120 on which the recording media 114 are stacked is provided in the paper supply unit 102. A feeder board 122 is connected to the front (the left-hand side in FIG. 1) of the paper supply platform 120, and the recording media 114 stacked on the paper supply platform 120 are supplied one sheet at a time, successively from the uppermost sheet, to the feeder board 122. The recording medium 114 that has been conveyed to the feeder board 122 is supplied to the surface (circumferential surface) of a pressure drum 126*a* of the permeation suppression processing unit 104 through a transfer drum 124*a* capable of rotating in the clockwise direction in FIG. 1.

The permeation suppression processing unit 104 is provided with a paper preheating unit 128, a permeation suppression agent head 130 and a permeation suppression agent drying unit 132 at positions opposing the surface (circumferential surface) of the pressure drum 126*a*, in this order from the upstream side in terms of the direction of rotation of the pressure drum 126*a* (the conveyance direction of the recording medium 114; the counter-clockwise direction in FIG. 1).

The paper preheating unit 128 and the permeation suppression agent drying unit 132 have heaters that can be temperature-controlled within prescribed ranges, respectively. When the recording medium 114 held on the pressure drum 126*a* passes through the positions opposing the paper preheating unit 128 and the permeation suppression agent drying unit 132, it is heated by the heaters of these units.

The permeation suppression agent head 130 ejects droplets of a permeation suppression agent onto the recording medium 114 that is held on the pressure drum 126*a*. The permeation suppression agent head 130 adopts the same composition as ink heads 140C, 140M, 140Y, 140K, 140R, 140G and 140B of the print unit 108, which is described below.

In the present embodiment, the inkjet head is used as the device for carrying out the permeation suppression processing on the surface of the recording medium 114; however, there are no particular restrictions on the device that carries out the permeation suppression processing. For example, it is also possible to use various other methods, such as a spray method, application method, or the like.

In the present embodiment, it is preferable to use a thermoplastic resin latex solution as the permeation suppression agent. Of course, the permeation suppression agent is not limited to being the thermoplastic resin latex solution, and for example, it is also possible to use lamina particles (e.g., mica), or a liquid rappelling agent (a fluoro-coating agent), or the like.

The treatment liquid deposition unit 106 is provided after the permeation suppression processing unit 104 (to the downstream side of same in terms of the direction of conveyance of the recording medium 114). A transfer drum 124*b* is arranged between the pressure drum 126*a* of the permeation suppression processing unit 104 and a pressure drum 126*b* of the treatment liquid deposition unit 106, so as to make contact with same. According to this a structure, after the recording medium 114 held on the pressure drum 126*a* of the permeation suppression processing unit 104 has been subjected to the permeation suppression processing, the recording medium 114 is transferred through the transfer drum 124*b* to the pressure drum 126*b* of the treatment liquid deposition unit 106.

The treatment liquid deposition unit 106 is provided with a paper preheating unit 134, a treatment liquid head 136 and a treatment liquid drying unit 138 at positions opposing the surface of the pressure drum 126*b*, in this order from the upstream side in terms of the direction of rotation of the pressure drum 126*b* (the counter-clockwise direction in FIG. 1).

The respective units of the treatment liquid deposition unit 106 (namely, the paper preheating unit 134, the treatment liquid head 136 and the treatment liquid drying unit 138) use similar compositions to the paper preheating unit 128, the permeation suppression agent head 130 and the permeation suppression agent drying unit 132 of the above-described permeation suppression processing unit 104, and explanation thereof is omitted here. Of course, it is also possible to employ different compositions from the permeation suppression processing unit 104.

The treatment liquid used in the present embodiment is an acidic liquid that has the action of aggregating the coloring materials contained in the inks that are ejected onto the recording medium 114 respectively from the ink heads 140C, 140M, 140Y, 140K, 140R, 140G and 140B disposed in the print unit 108, which is arranged at a downstream stage of the treatment liquid deposition unit 106.

The heating temperature of a heater of the treatment liquid drying unit 138 is set to a temperature that is suitable to dry the treatment liquid having been deposited on the surface of the recording medium 114 by the ejection operation of the treatment liquid head 136 arranged to the upstream side in terms of the direction of rotation of the pressure drum 126*b*, and thereby a solid or semi-solid aggregating treatment agent layer (a thin film layer of dried treatment liquid) is formed on the recording medium 114.

The "solid or semi-solid aggregating treatment agent layer" includes a layer having a water content rate of 0% to 70%, where the water content rate is defined as:

"Water content rate"="Weight of water contained in treatment liquid after drying, per unit surface area ($g/m^2$)"/"Weight of treatment liquid after drying, per unit surface area ($g/m^2$)".

A desirable mode is one in which the recording medium 114 is preheated by the heater of the paper preheating unit 134, before depositing the treatment liquid on the recording medium 114, as in the present embodiment. In this case, it is possible to restrict the heating energy required to dry the treatment liquid to a low level, and therefore energy savings can be made.

The print unit 108 is arranged at a downstream side of the treatment liquid deposition unit 106. The transfer drum 124*c* capable of rotating in the clockwise direction in FIG. 1 is arranged between the pressure drum 126*b* of the treatment liquid deposition unit 106 and a pressure drum 126*c* of the print unit 108, so as to make contact with same. According to this structure, after the treatment liquid is deposited and the solid or semi-solid aggregating treatment agent layer is formed on the recording medium 114 that is held on the pressure drum 126*b* of the treatment liquid deposition unit 106, the recording medium 114 is transferred through the transfer drum 124*c* to the pressure drum 126*c* of the print unit 108.

The print unit 108 is provided with the ink heads 140C, 140M, 140Y, 140K, 140R, 140G and 140B, which correspond respectively to the seven colors of ink, cyan (C), magenta (M), yellow (Y), black (K), red (R), green (G) and blue (B), and solvent drying units 142*a* and 142*b* at positions opposing the surface of the pressure drum 126*c*, in this order from the upstream side in terms of the direction of rotation of the pressure drum 126*c* (the counter-clockwise direction in FIG. 1).

The ink heads 140C, 140M, 140Y, 140K, 140R, 140G and 104B employ the inkjet type recording heads (inkjet heads), similarly to the permeation suppression agent head 130 and the treatment liquid head 136. The ink heads 140C, 140M, 140Y, 140K, 140R, 140G and 140B respectively eject droplets of corresponding colored inks onto the recording medium 114 held on the pressure drum 126*c*.

Each of the ink heads 140C, 140M, 140Y, 140K, 140R, 140G and 140B is a full-line head having a length corresponding to the maximum width of the image forming region of the recording medium 114 held on the pressure drum 126*c*, and having a plurality of nozzles 161 (shown in FIGS. 2A to 2C) for ejecting the ink, which are arranged on the ink ejection surface of the head through the full width of the image forming region. The ink heads 140C, 140M, 140Y, 140K, 140R, 140G and 140B are arranged so as to extend in a direction that is perpendicular to the direction of rotation of the pressure drum 126*c* (the conveyance direction of the recording medium 114).

According to the composition in which the full line heads having the nozzle rows covering the full width of the image forming region of the recording medium 114 are provided respectively for the colors of ink, it is possible to record a primary image on the image forming region of the recording medium 114 by performing just one operation of moving the recording medium 114 and the ink heads 140C, 140M, 140Y, 140K, 140R, 140G and 140B relatively with respect to each other (in other words, by one sub-scanning action). Therefore, it is possible to achieve a higher printing speed compared to a case that uses a serial (shuttle) type of head moving back and forth reciprocally in the main scanning direction, which is the direction perpendicular to the sub-scanning direction or the conveyance direction of the recording medium 114, and hence it is possible to improve the print productivity.

Moreover, although the configuration with the seven colors of C, M, Y, K, R, G and B is described in the present embodiment, the combinations of the ink colors and the number of colors are not limited to those. Light and/or dark inks, and special color inks can be added or removed as required. For example, a configuration is possible in which ink heads for ejecting light-colored inks, such as light cyan and light magenta are added, or a configuration of employing only four colors of C, M, Y and K is also possible. Furthermore, there is no particular restriction on the arrangement sequence of the heads of the respective colors.

Each of the solvent drying units 142*a* and 142*b* has a composition including a heater of which temperature can be controlled within a prescribed range, similarly to the paper preheating units 128 and 134, the permeation suppression agent drying unit 132, and the treatment liquid drying unit 138, which have been described above. As described hereinafter, when ink droplets are deposited onto the solid or semi-solid aggregating treatment agent layer, which has been formed on the recording medium 114, an ink aggregate (coloring material aggregate) is formed on the recording medium 114, and furthermore, the ink solvent that has separated from the coloring material spreads, so that a liquid layer containing dissolved aggregating treatment agent is formed. The solvent component (liquid component) left on the recording medium 114 in this way is a cause of curling of the recording medium 114 and also leads to deterioration of the image. Therefore, in the present embodiment, after depositing the droplets of the colored inks from the ink heads 140C, 140M, 140Y, 140K, 140R, 140G and 140B onto the recording medium 114, heating is carried out by the heaters of the solvent drying units 142*a* and 142*b*, and the solvent component is evaporated off and the recording medium 114 is dried.

The transparent UV ink deposition unit 110 is arranged at a downstream side of the print unit 108. A transfer drum 124*d* capable of rotating in the clockwise direction in FIG. 1 is arranged between the pressure drum 126*c* of the print unit 108 and a pressure drum 126*d* of the transparent U ink deposition unit 110, so as to make contact with same. Hence, after the colored inks are deposited on the recording medium 114 that is held on the pressure drum 126*c* of the print unit 108, the recording medium 114 is transferred through the transfer drum 124*d* to the pressure drum 126*d* of the transparent UV ink deposition unit 110.

The transparent UV ink deposition unit 110 is provided with a print determination unit 144, which reads in the print results of the print unit 108, a transparent UV ink head 146, and first UV light lamps 148*a* and 148*b* at positions opposing the surface of the pressure drum 126*d*, in this order from the upstream side in terms of the direction of rotation of the pressure drum 126*d* (the counter-clockwise direction in FIG. 1).

The print determination unit 144 includes an image sensor (a line sensor, or the like), which captures an image of the print result of the print unit 108 (the droplet ejection results of the ink heads 140C, 140M, 140Y, 140K, 140R, 140G and 140B), and functions as a device for checking for nozzle blockages, other ejection defects and non-uniformity of the image (density non-uniformity) formed by the droplet ejection, on the basis of the droplet ejection image captured through the image sensor.

The transparent UV ink head 146 employs the same composition as the ink heads 140C, 140M, 140Y, 140K, 140R, 140G and 140B of the print unit 108, and ejects droplets of the transparent UV ink so as to deposit the droplets of the transparent UV ink over the droplets of colored inks having been deposited on the recording medium 114 by the ink heads 140C, 140M, 140Y, 140K, 140R, 140G and 140B. Of course, it may also employ a composition different than the ink heads 140C, 140M, 140Y, 140K, 140R, 140G and 140B of the print unit 108.

The first UV lamps 148*a* and 148*b* cure the transparent UV ink by irradiating UV light onto the transparent UV ink on the recording medium 114 when the recording medium 114 passes the positions opposing the first UV lamps 148*a* and 148*b* after the droplets of the transparent UV ink have been deposited on the recording medium 114.

In the present embodiment, the liquid droplet volume ejected from the nozzles of the transparent UV ink head 146 (the transparent UV ink droplet deposition volume) is controlled by a later described print controller 182 (see FIG. 5), in such a manner that the thickness of the layer of transparent UV ink after the irradiation of UV light is not greater than 5 μm (desirably not greater than 3 μm, and more desirably, not smaller than 1 μm and not greater than 3 μm). The "thickness of the layer of transparent UV ink after irradiation of UV light" is the thickness of the layer of transparent UV ink after irradiation of UV light by a second UV lamp 156 in FIG. 1, which is described hereinafter. In other words, if there are a plurality of UV lamps, then it is the thickness of the layer of transparent UV ink after UV light has been irradiated thereon by the UV lamp in the furthest downstream position in terms of the direction of conveyance of the recording medium.

The paper output unit 112 is arranged at a downstream side of the transparent UV ink deposition unit 110. The paper output unit 112 is provided with a paper output drum 150, which receives the recording medium 114 on which the droplets of the transparent UV ink have been deposited, a paper output platform 152, on which the recording media 114 are stacked, and a paper output chain 154 having a plurality of paper output grippers, which is spanned between a sprocket arranged on the paper output drum 150 and a sprocket arranged above the paper output platform 152.

The second UV lamp 156 is arranged at the inner side of the paper output chain 154 between the sprockets. The second UV lamp 156 cures the transparent UV ink by irradiating UV light onto the transparent UV ink on the recording medium 114, by the time that the recording medium 114 having been transferred from the pressure drum 126*d* of the transparent UV ink deposition unit 110 to the paper output drum 150 is conveyed by the paper output chain 154 to the paper output platform 152.

FIG. 1 shows an embodiment of the three-liquid inkjet recording apparatus 100 including the permeation suppression processing unit 104 and the treatment liquid deposition unit 106; however, it is also possible to modify or omit these processing blocks appropriately in accordance with the properties of the ink used.

Configuration of Print Unit

Next, the structure of the ink heads 140C, 140M, 140Y, 140K, 140R, 140G and 140B disposed in the print unit 108 is described in detail. The ink heads 140C, 140M, 140Y, 140K, 140R, 140G and 140B have a common structure, and in the following description, these heads are represented by an ink head (hereinafter, simply called a "head") denoted with reference numeral 160.

Figure 2A:
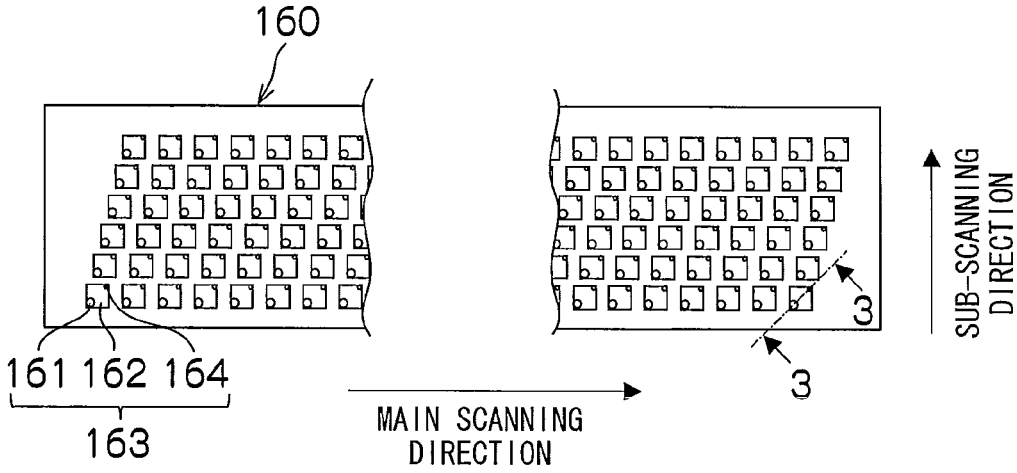
FIGS. 2A to 2C are plan view perspective diagrams showing examples of the head shown in FIG. 1.
Figure 2B:
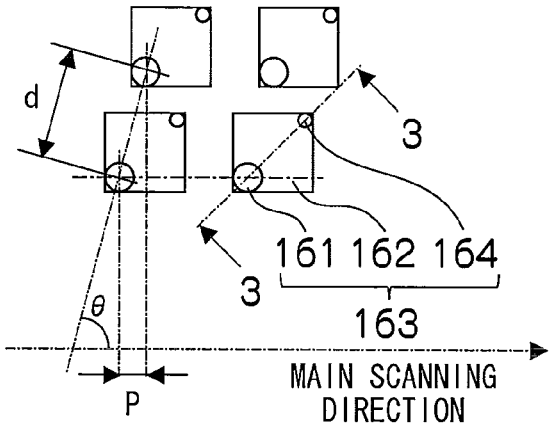
Figure 2C:
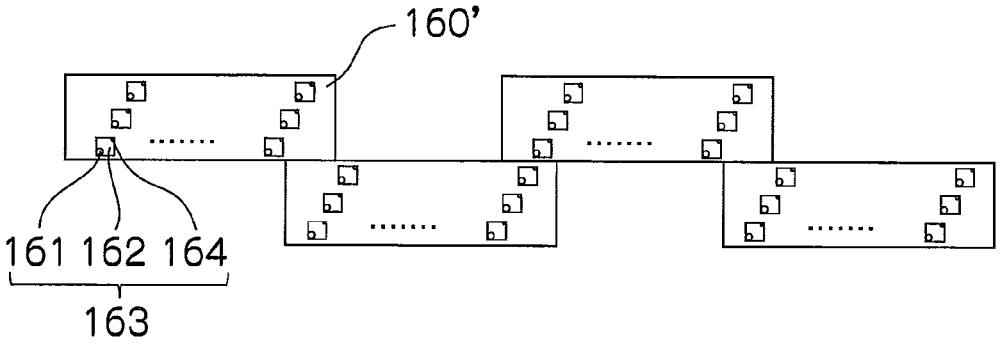
Figure 3:
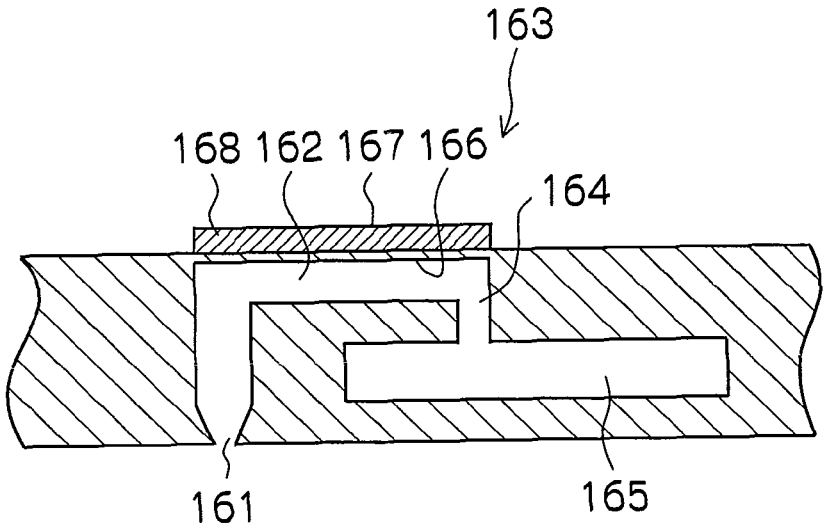
FIG. 3 is a cross-sectional diagram along line 3-3 in FIGS. 2A and 2B.

FIG. 2A is a plan view perspective diagram showing an embodiment of the structure of the head 160; FIG. 2B is an enlarged diagram showing a portion of the head; and FIG. 2C is a plan view perspective diagram showing a further embodiment of the structure of the head 160. FIG. 3 is a cross-sectional diagram along line 3-3 in FIGS. 2A and 2B, and shows the three-dimensional composition of an ink chamber unit.

The nozzle pitch in the head 160 should be minimized in order to maximize the density of the dots formed on the surface of the recording medium 114. As shown in FIGS. 2A and 2B, the head 160 according to the present embodiment has a structure in which a plurality of ink chamber units 163, each having a nozzle 161 forming an ink droplet ejection port, a pressure chamber 162 corresponding to the nozzle 161, and the like, are disposed two-dimensionally in the form of a staggered matrix, and hence the effective nozzle interval (the projected nozzle pitch) as projected in the lengthwise direction of the head (the main-scanning direction perpendicular to the recording medium conveyance direction (sub-scanning direction)) is reduced and high nozzle density is achieved.

The mode of forming one or more nozzle rows through a length corresponding to the entire width of the recording area of the recording medium 114 in a direction substantially perpendicular to the conveyance direction of the recording medium 114 is not limited to the embodiment described above. For example, instead of the configuration in FIG. 2A, as shown in FIG. 2C, a line head having the nozzle rows of the length corresponding to the entire width of the recording area of the recording medium 114 can be formed by arranging and combining, in a staggered matrix, short head blocks 160' each having a plurality of nozzles 161 arrayed two-dimensionally. Furthermore, although not shown in the drawings, it is also possible to compose a line head by arranging short heads in one row.

The pressure chamber 162 provided corresponding to each of the nozzles 161 is approximately square-shaped in plan view, and the nozzle 161 and a supply port 164 are arranged respectively at corners on a diagonal of the pressure chamber 162. As shown in FIG. 3, each pressure chamber 162 is connected through the supply port 164 to a common flow channel 165. The common flow channel 165 is connected to an ink supply tank 170 (shown in FIG. 4), which is a base tank that supplies ink, and the ink supplied from the ink supply tank is delivered through the common flow channel 165 to the pressure chambers 162.

As shown in FIG. 3, a piezoelectric element 168 provided with an individual electrode 167 is bonded to a diaphragm 166, which forms the upper face of the pressure chamber 162 and also serves as a common electrode, and the piezoelectric element 168 is deformed when a drive voltage is applied to the individual electrode 167, thereby causing the ink to be ejected from the nozzle 161. When the ink is ejected, new ink is supplied to the pressure chamber 162 from the common flow passage 165 through the supply port 164.

In the present embodiment, the piezoelectric element 168 is used as an ink ejection force generating device, which causes the ink to be ejected from the nozzle 160 in the head 161; however, it is also possible to employ a thermal method in which a heater is provided inside the pressure chamber 162 and the ink is ejected by using the pressure of the film boiling action caused by the heating action of this heater.

As shown in FIG. 2B, the high-density nozzle arrangement according to the present embodiment is achieved by arranging the plurality of ink chamber units 163 having the above-described structure in a lattice fashion based on a fixed arrangement pattern, in a row direction that coincides with the main scanning direction, and a column direction that is inclined at a fixed angle of θ with respect to the main scanning direction, rather than being perpendicular to the main scanning direction.

More specifically, by adopting the structure in which the plurality of ink chamber units 163 are arranged at the uniform pitch d in line with the direction forming the angle of θ with respect to the main scanning direction, the pitch P of the nozzles projected so as to align in the main scanning direction is d×cos θ, and hence the nozzles 161 can be regarded to be equivalent to those arranged linearly at the fixed pitch P along the main scanning direction. Such configuration results in the nozzle structure in which the nozzle row projected in the main scanning direction has a high nozzle density of up to 2,400 nozzles per inch.

When implementing the present invention, the arrangement structure of the nozzles is not limited to the embodiment shown in the drawings, and it is also possible to apply various other types of nozzle arrangements, such as an arrangement structure having one nozzle row in the sub-scanning direction.

Furthermore, the scope of application of the present invention is not limited to a printing system based on the line type of head, and it is also possible to adopt a serial system where a short head that is shorter than the breadthways dimension of the recording medium 114 is moved in the breadthways direction (main scanning direction) of the recording medium 114, thereby performing printing in the breadthways direction, and when one printing action in the breadthways direction has been completed, the recording medium 114 is moved through a prescribed amount in the sub-scanning direction perpendicular to the breadthways direction, printing in the breadthways direction of the recording medium 114 is carried out in the next printing region, and by repeating this sequence, printing is performed over the whole surface of the printing region of the recording medium 114.

Configuration of Ink Supply System

Figure 4:
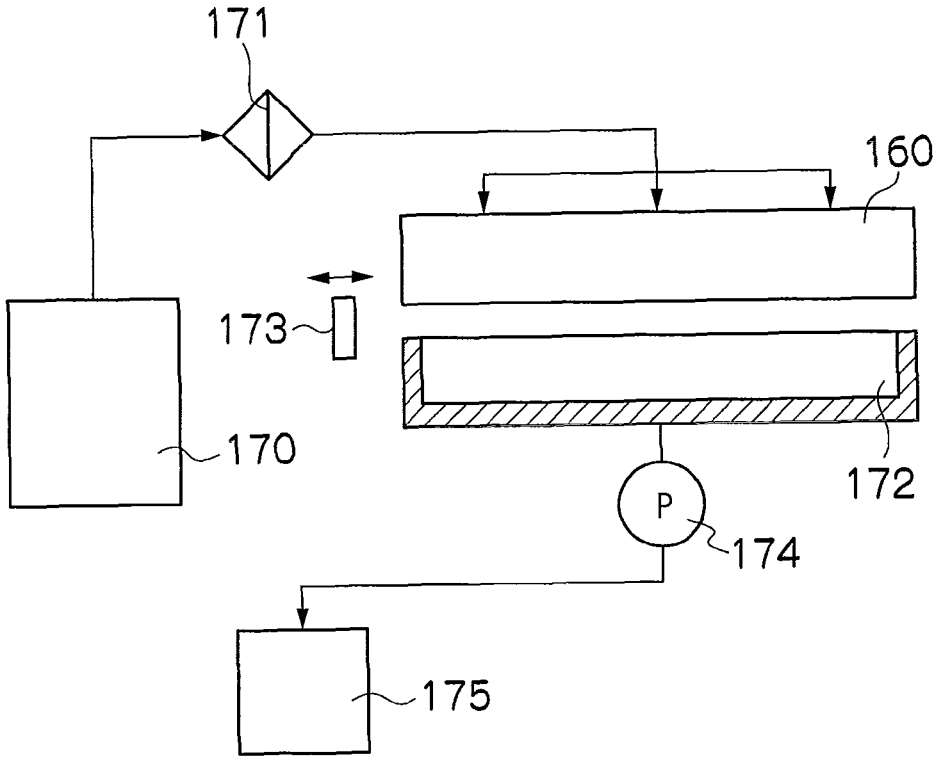
FIG. 4 is a conceptual diagram showing the composition of an ink supply system of the inkjet image recording apparatus shown in FIG. 1.

FIG. 4 is a schematic drawing showing the configuration of the ink supply system in the inkjet recording apparatus 100. The ink supply tank 170 is the base tank that supplies the ink to the head 160. The aspects of the ink supply tank 170 include a refillable type and a cartridge type: when the remaining amount of ink is low, the ink tank of the refillable type is filled with ink through a filling port (not shown) and the ink tank of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type.

A filter 171 for removing foreign matters and bubbles is disposed between the ink supply tank 170 and the head 160 as shown in FIG. 4. The filter mesh size in the filter is preferably equivalent to or less than the diameter of the nozzle and commonly about 20 μm.

Although not shown in FIG. 4, it is preferable to provide a sub-tank integrally to the print head 160 or nearby the head 160. The sub-tank has a damper function for preventing variation in the internal pressure of the head and a function for improving refilling of the print head.

The inkjet recording apparatus 100 is also provided with a cap 172 as a device to prevent the nozzles 161 from drying out or to prevent an increase in the ink viscosity in the vicinity of the nozzles 161, and a cleaning blade 173 as a device to clean the ink ejection surface of the head 160. The cap 172 can be relatively moved with respect to the head 160 by a movement mechanism (not shown), and is moved from a predetermined holding position to a maintenance position below the head 160 as required.

The cap 172 is moved up and down relatively with respect to the head 160 by an elevator mechanism (not shown). When the power of the inkjet recording apparatus 100 is turned OFF or when in a print standby state, the cap 172 is raised to a predetermined elevated position so as to come into close contact with the head 160, and the nozzle face is thereby covered with the cap 172.

During printing or standby, if the use frequency of a particular nozzle 161 is low, and if a state of not ejecting ink continues for a prescribed time period or more, then the solvent of the ink in the vicinity of the nozzle evaporates and the viscosity of the ink increases. In a situation of this kind, it will become impossible to eject ink from the nozzle 161, even if the piezoelectric element 168 (see FIG. 3) is operated.

Therefore, before a situation of this kind develops (namely, while the ink is within a range of viscosity which allows it to be ejected by operation of the piezoelectric element 168), the piezoelectric element 168 is operated, and a preliminary ejection ("purge", "blank ejection", "liquid ejection" or "dummy ejection") is carried out toward the cap 172 (ink receptacle), in order to expel the degraded ink (namely, the ink in the vicinity of the nozzle which has increased viscosity).

Furthermore, if bubbles enter into the ink inside the head 160 (inside the pressure chamber 162; see FIG. 3), then even if the piezoelectric element 168 is operated, it will not be possible to eject ink from the nozzle. In a case of this kind, the cap 172 is placed on the head 160, the ink (ink containing bubbles) inside the pressure chamber 162 is removed by suction, by means of a suction pump 174, and the ink removed by suction is then supplied to a recovery tank 175.

This suction operation is also carried out in order to remove degraded ink having increased viscosity (hardened ink), when ink is loaded into the head for the first time, and when the head starts to be used after having been out of use for a long period of time. Since the suction operation is carried out with respect to all of the ink inside the pressure chamber 162, the ink consumption is considerably large. Therefore, desirably, preliminary ejection is carried out when the increase in the viscosity of the ink is still minor.

In the inkjet recording apparatus 100, the maintenance of the head 160 is carried out after moving the head 160 from the image forming position directly above the pressure drums 126*a* to 126*d* to a prescribed maintenance position.

Description of Control System

Figure 5:
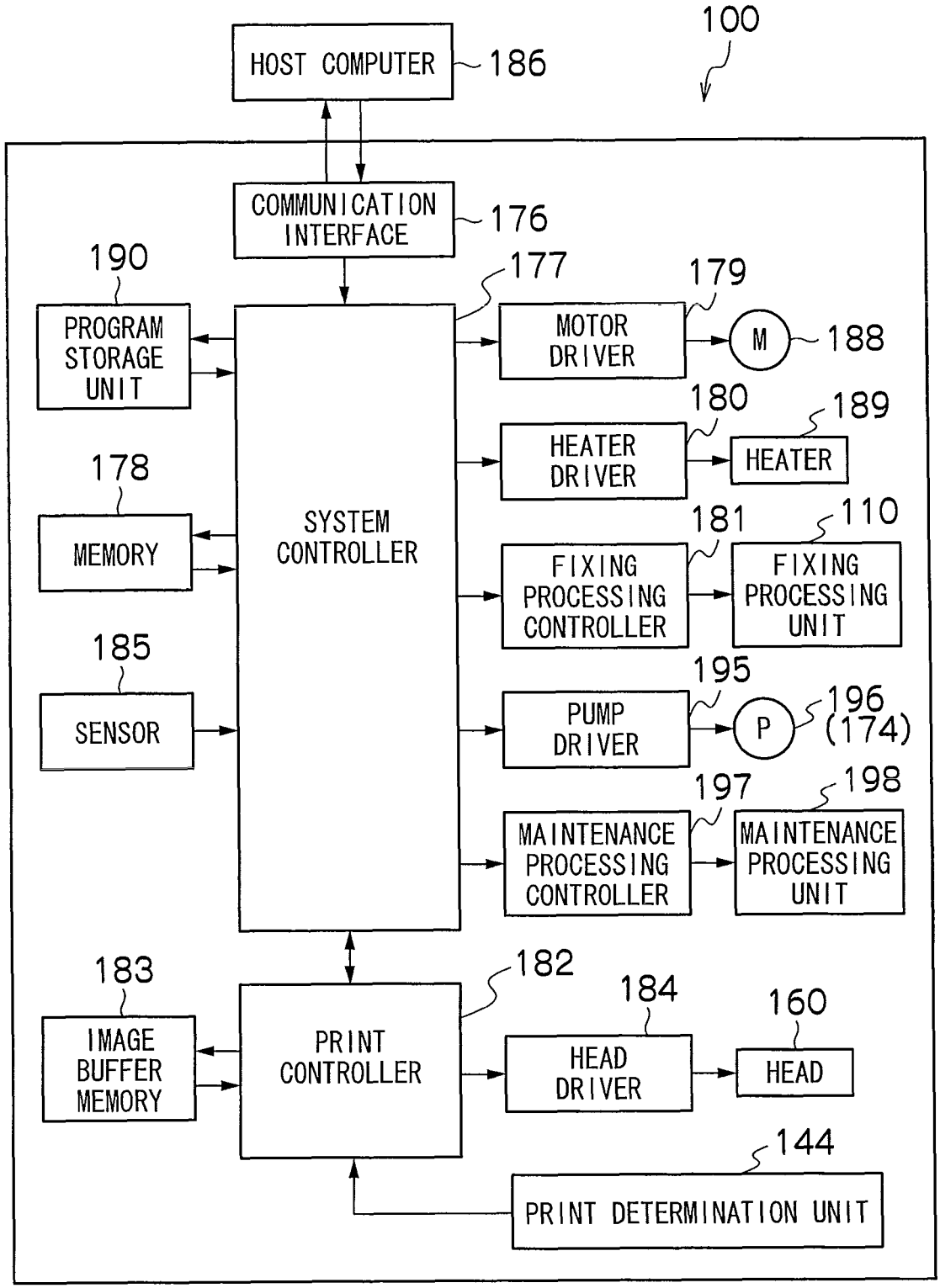
FIG. 5 is a principal block diagram showing the system configuration of the inkjet recording apparatus shown in FIG. 1.

FIG. 5 is a principal block diagram showing the system configuration of the inkjet recording apparatus 100. The inkjet recording apparatus 100 includes a communication interface 176, a system controller 177, a memory 178, a motor driver 179, a heater driver 180, a fixing processing controller 181, the print controller 182, an image buffer memory 183, a head driver 184, a pump driver 195, a maintenance processing controller 197, and the like.

The communication interface 176 is an interface unit for receiving image data sent from a host computer 186. A serial interface such as USB (Universal Serial Bus), IEEE1394, Ethernet, wireless network, or a parallel interface such as a Centronics interface may be used as the communication interface 176. A buffer memory (not shown) may be mounted in this portion in order to increase the communication speed. The image data sent from the host computer 186 is received by the inkjet recording apparatus 100 through the communication interface 176, and is temporarily stored in the memory 178.

The memory 178 is a storage device for temporarily storing image data inputted through the communication interface 176, and data is written and read to and from the memory 178 through the system controller 177. The memory 178 is not limited to a memory composed of semiconductor elements, and a hard disk drive or another magnetic medium may be used.

The system controller 177 is constituted of a central processing unit (CPU) and peripheral circuits thereof, and the like, and it functions as a control device for controlling the whole of the inkjet recording apparatus 100 in accordance with a prescribed program, as well as a calculation device for performing various calculations. More specifically, the system controller 177 controls the various sections, such as the communication interface 176, memory 178, motor driver 179, heater driver 180, and the like, as well as controlling communications with the host computer 186 and writing and reading to and from the memory 178, and it also generates control signals for controlling a motor 188, a heater 189 and a pump 196 of the conveyance system.

The program executed by the CPU of the system controller 177 and the various types of data which are required for control procedures are stored in the memory 178. The memory 178 may be a non-rewriteable storage device, or it may be a rewriteable storage device, such as an EEPROM. The memory 178 is used as a temporary storage region for the image data, and it is also used as a program development region and a calculation work region for the CPU.

Various control programs are stored in the program storage unit 190, and a control program is read out and executed in accordance with commands from the system controller 177. The program storage unit 190 may use a semiconductor memory, such as a ROM, EEPROM, or a magnetic disk, or the like. An external interface may be provided, and a memory card or PC card may also be used. Naturally, a plurality of these recording media may also be provided. The program storage unit 190 may also be combined with a storage device for storing operational parameters, and the like (not shown).

The motor driver 179 is a driver that drives the motor 188 in accordance with instructions from the system controller 177. In FIG. 5, the plurality of motors (actuators) disposed in the respective sections of the inkjet recording apparatus 100 are represented by the reference numeral 188. For example, the motor 188 shown in FIG. 5 includes the motors that drive the pressure drums 126*a* to 126*d* (a conveyance drum 300 in FIG. 7), the transfer drums 124*a* to 124*d* and the paper output drum 150, shown in FIG. 1.

The heater driver 180 is a driver that drives the heater 189 in accordance with instructions from the system controller 177. In FIG. 5, the plurality of heaters disposed in the inkjet recording apparatus 100 are represented by the reference numeral 189. For example, the heater 189 shown in FIG. 5 includes the heaters of the paper preheating units 128 and 134, the permeation suppression agent drying unit 132, the treatment liquid drying unit 138, the solvent drying units 142*a* and 142*b*, and the like, shown in FIG. 1.

The fixing processing unit 110 in FIG. 5 is depicted as the transparent UV ink deposition unit 110 in FIG. 1. In other words, FIG. 1 shows as one mode of the fixing processing unit 110 in FIG. 5 a mode where a transparent UV ink layer is formed over the image. The fixing processing unit 110 is not limited to the mode forming the transparent UV ink layer, and it is also possible to employ a mode which heats the recording medium after image formation by means of a heating device, a mode which applies pressure to an image formed on the recording medium by means of a pressing device, such as a pressing roller, a mode which combines the use of heating and pressing by means of a pressing roller having a built-in heater, or the like.

The fixing processing controller 181 functions as the UV light irradiation controller, which controls the UV light irradiation amount and the UV light irradiation timing of the first UV lamps 148*a* and 148*b* and the second UV lamp 156 in FIG. 1. The optimum irradiation time, irradiation interval and irradiation intensity of the UV lamps 148*a*, 148*b* and 156 are determined in advance for each type of recording medium 114 and each type of transparent UV ink, this information is stored in a prescribed memory (for example, the memory 178) in the form of a data table, and when the fixing processing controller 181 acquires information about the recording medium 114 and information about the ink used, then it controls the irradiation time, the irradiation interval and the irradiation intensity accordingly by referring to the memory.

By controlling the irradiation time, the irradiation interval and the irradiation intensity of the ultraviolet lamps 148*a*, 148*b* and 156, it is possible to control the gloss appearance (surface shape) of the images, and hence images having different gloss appearances can be achieved. For example, it is possible to suppress permeation of transparent UV ink into the recording medium 114 by raising the viscosity of the transparent UV ink in the vicinity of the interface with the recording medium 114, by means of the first UV lamps 148*a* and 148*b*, and to then cure the transparent UV ink from the interior until the surface by means of the second UV lamp 156. Instead of (or in addition to) controlling the irradiation time, the irradiation interval and the irradiation intensity of the UV lamps 148*a*, 148*b* and 156, it is also possible to control the speed at which the recording medium 114 is conveyed, or to alter the positions of the respective ultraviolet lamps 148*a*, 148*b* and 156. Furthermore, it is also possible to append a drying unit between the first UV lamps 148*a* and 148*b* and the second UV lamp 156, in such a manner that the permeation of the transparent UV ink into the recording medium 114 after the deposition of droplets of the transparent UV ink is suppressed by the first UV lamps 148*a* and 148*b*, and furthermore the transparent UV ink is cured by the second UV lamp 156 after the solvent in the transparent UV ink has been removed by the drying unit.

The control object of the fixing processing controller 181 is determined in accordance with the composition of the fixing processing unit 110.

The pump driver 195 controls the vacuum pump 196, which generates suction pressure for fixing and holding the recording medium 114 to the pressure drums 126*a* to 126*d* (a conveyance drum 300 in FIG. 7) and the suction pump 174 in FIG. 4. For example, in the inkjet recording apparatus 100 shown in FIG. 1, when the recording medium 114 of which prescribed processing has been finished reaches the pressure drum 126*c* of the print unit 108, the vacuum pump 196 connected to the vacuum flow channel of the pressure drum 126*c* is driven, and a vacuum (negative pressure) corresponding to the type, size and bending rigidity of the recording medium 114 is generated.

More specifically, when information about the type of recording medium 114 is acquired by the system controller 177, then this information about the recording medium 114 is sent to the pump driver 195. The pump driver 195 sets a suction pressure in accordance with the information about the recording medium 114 and controls the on and off switching and generated pressure of the vacuum pump 196 in accordance with this setting.

If a recording medium 114 such as thin paper having lower bending rigidity than the standard bending rigidity is used, then the suction pressure is set to be lower than standard, whereas if a recording medium 114 such as thick paper having higher bending rigidity than the standard bending rigidity is used, then the suction pressure is set to be higher than standard. Furthermore, depending on the thickness of the recording medium 114, if a recording medium 114 having a greater thickness than the standard thickness is used, then a higher suction pressure than standard is set, and if a recording medium 114 having a smaller thickness than the standard thickness is used, then a lower suction pressure than standard is set. It is preferable that appropriate suction pressures are predetermined in association with the types (e.g., thicknesses and bending rigidities) of recording media 114, and this information is stored in a prescribed memory (for example, the memory 178 in FIG. 5) in the form of a data table.

FIG. 5 shows only one vacuum pump 196; however, it is possible to provide vacuum pumps respectively for the pressure drums 126*a* to 126*d* and the transfer drums 124*a* to 124*d*, or it is also possible to provide a single vacuum pump and a switching device such as a control valve arranged in the vacuum flow channel so as to connect the single vacuum pump selectively with one of the pressure drums 126*a* to 126*d* and the transfer drums 124*a* to 124*d*. Furthermore, it is also possible to include a compressor in the vacuum pump 196 in FIG. 5.

The maintenance processing controller 197 is a functional block which controls the maintenance processing unit 198 that carries out maintenance of the respective sections of the inkjet recording apparatus 100, on the basis of control signals sent from the system controller 177. FIG. 5 shows individual blocks which have a function of the maintenance processing control unit 197 and the maintenance processing unit 198; however, it is also possible to achieve these as functions of other blocks.

The maintenance processing unit 198 in FIG. 5 includes: a movement mechanism which moves the head 160 to a maintenance position, a movement mechanism of the cap 172 which abuts the cap 172 (see FIG. 4) against the head 160, the piezoelectric elements 168 (see FIG. 3) which perform preliminary ejection, and the suction pump 174 (see FIG. 4) which sucks the nozzles 161 (see FIG. 3), and the like.

The print controller 182 has a signal processing function for performing various tasks, compensations, and other types of processing for generating print control signals from the image data stored in the memory 178 in accordance with commands from the system controller 177 so as to supply the generated print data (dot data) to the head driver 184. Prescribed signal processing is carried out in the print controller 182, and the ejection amount and the ejection timing of the ink droplets from the respective print heads 160 are controlled through the head driver 184, on the basis of the print data. By this means, desired dot size and dot positions can be achieved. In FIG. 5, the plurality of heads (inkjet heads) which are provided in the inkjet recording apparatus 100 are represented by the reference numeral 160. For example, the head 160 illustrated in FIG. 5 includes the permeation suppression agent head 130, the treatment liquid head 136, the ink heads 140C, 140M, 140Y, 140K, 140R, 140G and 140B, and the transparent UV ink head 146 which are illustrated in FIG. 1.

The print controller 182 is provided with the image buffer memory 183; and image data, parameters, and other data are temporarily stored in the image buffer memory 183 when image data is processed in the print controller 182. Also possible is an aspect in which the print controller 182 and the system controller 177 are integrated to form a single processor.

The head driver 184 generates drive signals to be applied to the piezoelectric elements 168 of the head 160, on the basis of image data (dot data) supplied from the print controller 182, and includes drive circuits which drive the piezoelectric elements 168 by applying the drive signals to the piezoelectric elements 168. A feedback control system for maintaining constant drive conditions in the head 160 may be included in the head driver 184 illustrated in FIG. 5.

The print determination unit 144 is a block that includes a line sensor as described above with reference to FIG. 1, reads the image printed on the recording medium 114, determines the print conditions (presence of the ejection, variation in the dot formation, and the like) by performing prescribed signal processing, or the like, and provides the determination results of the print conditions to the print controller 182.

According to requirements, the print controller 182 makes various corrections with respect to the head 160 on the basis of information obtained from the print determination unit 144. Furthermore, a desirable mode is one in which the image non-uniformity is measured using the print determination unit 144, and if there is non-uniformity caused by depressions in the recording medium 114, then a control signal is sent from the system controller 177 to the pump driver 195 to implement control in such a manner that the flow rate of the vacuum pump 196 is reduced.

A desirable mode is one in which a similar composition to the print determination unit 144 (a recording medium determination sensor) is provided before the pressure drum 124*a* in FIG. 1, and the thickness and surface properties of the recording medium 114 are read in by this recording medium determination sensor, in such a manner that the type of recording medium 114 is judged on the basis of this information.

The sensor 185 indicates various sensors which are provided in the respective units of the inkjet recording apparatus 100. The sensor 185 includes a temperature sensor, a position determination sensor, a pressure sensor, and the like. The output signals of the sensor 185 are sent to the system controller 177, and the system controller 177 sends control signals to the respective units of the inkjet recording apparatus 100 on the basis of these output signals, whereby the respective units of the apparatus are controlled.

The image forming method of the inkjet recording apparatus 100 which has this composition will now be described.

The recording medium 114 is conveyed to the feeder board 122 from the paper supply platform 120 of the paper supply unit 102. The recording medium 114 is transferred through the transfer drum 124*a* and held on the pressure drum 126*a* of the permeation suppression processing unit 104, and is preheated by the paper preheating unit 128, and droplets of permeation suppression agent are deposited on the recording medium 114 by the permeation suppression agent head 130. Thereupon, the recording medium 114 held on the pressure drum 126*a* is heated by the permeation suppression agent drying unit 132, and the solvent component (liquid component) of the permeation suppression agent is evaporated off and the recording medium 114 is thereby dried.

The recording medium 114 that has been thus subjected to the permeation suppression processing is transferred from the pressure drum 126*a* of the permeation suppression processing unit 104 through the transfer drum 124*b* to the pressure drum 126*b* of the treatment liquid deposition unit 106. The recording medium 114 held on the pressure drum 126*b* is preheated by the paper preheating unit 134, and droplets of treatment liquid are deposited on the recording medium 114 by the treatment liquid head 136. Thereupon, the recording medium 114 held on the pressure drum 126*b* is heated by the treatment liquid drying unit 138, and the solvent component (liquid component) of the treatment liquid is evaporated off and the recording medium 114 is thereby dried. Thus, a solid or semi-solid aggregating treatment agent layer is formed on the recording medium 114.

The recording medium 114 on which the solid or semi-solid aggregating treatment agent layer has been formed is transferred from the pressure drum 126*b* of the treatment liquid deposition unit 106 though the transfer drum 124*c* to the pressure drum 126*c* of the print unit 108. Droplets of corresponding colored inks are ejected respectively from the ink heads 140C, 140M, 140Y, 140K, 140R, 140G and 140B, onto the recording medium 114 held on the pressure drum 126*c*, in accordance with the input image data.

When the ink droplets are deposited onto the aggregating treatment agent layer, then the contact interface between each ink droplet and the aggregating treatment agent layer has a prescribed area when the ink droplet lands, due to a balance between the kinetic energy and the surface energy. The aggregating reaction starts immediately after the ink droplets have landed on the aggregating treatment agent, and the aggregating reaction starts from the surface of each ink droplet in contact with the aggregating treatment agent layer. Since the aggregating reaction occurs only in the vicinity of the contact surface, and the coloring material in the ink aggregates while the ink droplet obtains an adhesive force in the prescribed contact interface area upon landing of the ink droplet, then movement of the coloring material is suppressed.

Even if another ink droplet is subsequently deposited adjacently to the ink droplet deposited previously, since the coloring material of the previously deposited ink has already aggregated, then the coloring material does not mix with the subsequently deposited ink, and therefore bleeding is suppressed. After the aggregation of the coloring material, the separated ink solvent spreads, and a liquid layer containing dissolved aggregating treatment agent is formed on the recording medium 114.

Thereupon, the recording medium 114 held on the pressure drum 126*c* is heated by the solvent drying units 142*a* and 142*b*, and the solvent component (liquid component) that has been separated from the ink aggregate on the recording medium 114 is evaporated off and the recording medium 114 is thereby dried. Thus, curling of the recording medium 114 is prevented, and furthermore deterioration of the image quality as a result of the presence of the solvent component can be restricted.

The recording medium 114 onto which the colored inks have been deposited by the print unit 108 is transferred from the pressure drum 126*c* of the print unit 108 through the transfer drum 124*d* to the pressure drum 126*d* of the transparent UV ink deposition unit 110. The print results produced by the print unit 108 on the recording medium 114 held on the pressure drum 126*d* are read in by the print determination unit 144, whereupon droplets of the transparent UV ink are ejected from the transparent UV ink head 146 over the colored inks on the recording medium 114.

Then, the recording medium 114 held on the pressure drum 126*d* passes the positions opposing the first UV lamps 148*a* and 148*b*, while UV light is irradiated onto the transparent UV ink on the recording medium 114 by the first UV lamps 148*a* and 148*b*. Thereby, the transparent UV ink on the recording medium 114 is raised in viscosity at the interface with the recording medium 114 and hence the permeation of the transparent UV ink into the recording medium 114 is suppressed.

Then, the recording medium 114 is subsequently transferred from the pressure drum 126*d* to the paper output drum 150 and passes the position opposing the second UV lamp 156 while being conveyed to the paper output tray 152 by the paper output chain 154, while UV light is irradiated onto the transparent UV ink on the recording medium 114 by the second UV lamp 156. Thereby, the transparent UV ink on the recording medium 114 assumes a state where it is cured from the surface through to the interior.

When the transparent UV ink is deposited onto the recording medium 114 in the transparent UV ink deposition unit 110, the droplet ejection volume of the transparent UV ink head 146 is controlled by the print controller 182 shown in FIG. 5 in such a manner that the thickness of the layer of the transparent UV ink after the irradiation of UV light is not greater than 5 μm (desirably not greater than 3 μm, and more desirably, not smaller than 1 μm and not greater than 3 μm). Consequently, due to the irradiation of UV light by the first UV lamps 148*a* and 148*b* and the second UV lamp 156, the thin film layer made of the transparent UV ink (transparent UV coating layer) is formed so as to cover the colored inks on the recording medium 114, and hence an image having a glossy appearance similar to offset printing is achieved on the recording medium 114.

The recording medium 114 on which the image has been thus formed is then conveyed onto the paper output platform 152 by the paper output chain 154 and is stacked on the paper output platform 152.

Figure 6:
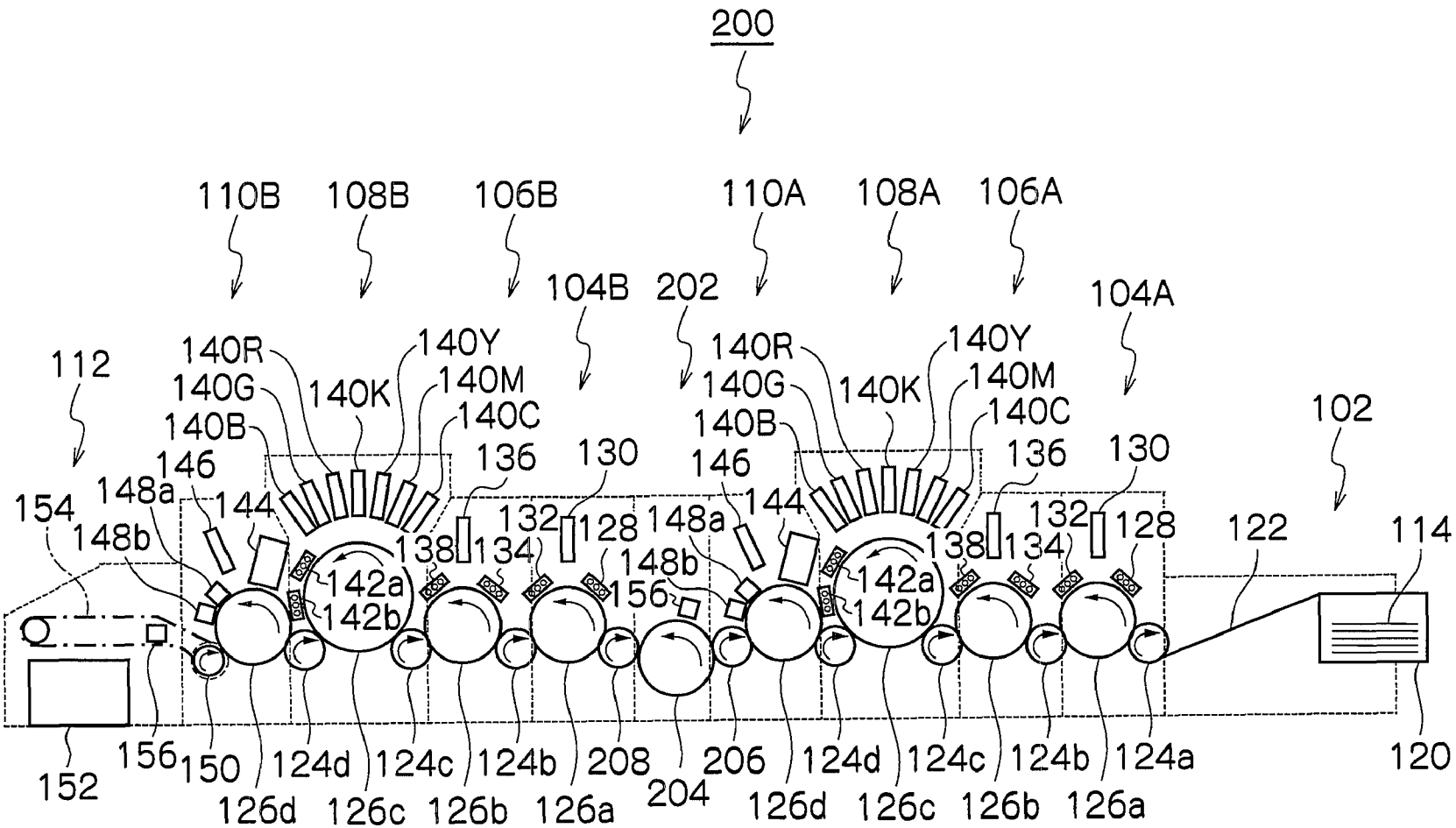
FIG. 6 is an approximate compositional diagram showing a further embodiment of the image recording apparatus shown in FIG. 1.

FIG. 6 is a conceptual diagram of a case where the inkjet recording apparatus 100 in FIG. 1 is applied to a double side machine (inkjet recording apparatus 200). In FIG. 6, members that are the same as or similar to FIG. 1 are denoted with the same reference numerals and description thereof is omitted here.

The inkjet recording apparatus 200 shown in FIG. 6 is a double side machine, which is capable of printing onto both surfaces of a recording medium 114. The inkjet recording apparatus 200 includes: in order from the upstream side in terms of the direction of conveyance of the recording medium 114 (the right to left direction in FIG. 6), a paper supply unit 102, a first permeation suppression processing unit 104A, a first treatment liquid deposition unit 106A, a first print unit 108A, a first transparent UV ink deposition unit 110A, a reversing unit 202, which reverses the recording surface (image forming surface) of the recording medium 114, a second permeation suppression processing unit 104B, a second treatment liquid deposition unit 106B, a second print unit 108B, a second transparent UV ink deposition unit 110B, and a paper output unit 112. The image forming apparatus 200 is thus provided with a composition including the permeation suppression processing unit 104, the treatment liquid deposition unit 106, the print unit 108 and the transparent UV ink deposition unit 110 of the inkjet recording apparatus 100 shown in FIG. 1, on each side of the reversing unit 202.

In the inkjet recording apparatus 200 according to the present embodiment, firstly, similarly to the inkjet recording apparatus 100 shown in FIG. 1, permeation suppression processing and droplet deposition of the treatment liquid, the colored inks, and the transparent UV ink are carried out by the first permeation suppression processing unit 104A, the first treatment liquid deposition unit 106A, the first print unit 108A, and the first transparent UV ink deposition unit 110A successively onto one surface of the recording medium 114, which is supplied from the paper supply unit 102.

After thereby forming an image on the one surface of the recording medium 114, the recording medium 114 is reversed when it is transferred to the reversing drum 204 from the pressure drum 126*d* of the first transparent UV ink deposition unit 110A through the transfer drum 206. The reversal mechanism for the recording medium 114 employs commonly known technology and therefore a concrete description is not given here. A second UV lamp 156 is arranged at a position opposing the surface of the reversing drum 204, and this serves to cure the transparent UV ink that has been deposited on the recording medium 114, together with the first UV lamps 148*a* and 148*b* of the first transparent UV ink deposition unit 110A.

The recording medium 114 that has been reversed is transferred from the reversing drum 204 through the transfer drum 208 to the pressure drum 126*a* of the second permeation suppression processing unit 104B. Thereupon, permeation suppression processing and droplet deposition of the treatment liquid, the colored inks, and the transparent UV ink, and the like, are carried out by the second permeation suppression processing unit 104B, the second treatment liquid deposition unit 106B, the second print unit 108B and the second transparent UV ink deposition unit 110B successively onto the other surface of the recording medium 114.

After thus forming the images on both surfaces of the recording medium 114, the recording medium 114 is conveyed onto the paper output platform 152 by the paper output chain 154, and is stacked on the paper output platform 152.

Description of Structure of Pressure Drum (Conveyance Drum)

Next, the structure of the pressure drums 126*a* to 126*d* which function as devices for holding and conveying the recording medium 114 will be described in detail. Since the pressure drums 126*a* to 126*d* shown in FIG. 1 have a common structure, then a conveyance drum 300 is described below as a general representation of the pressure drums 126*a* to 126*d*.

Figure 7:
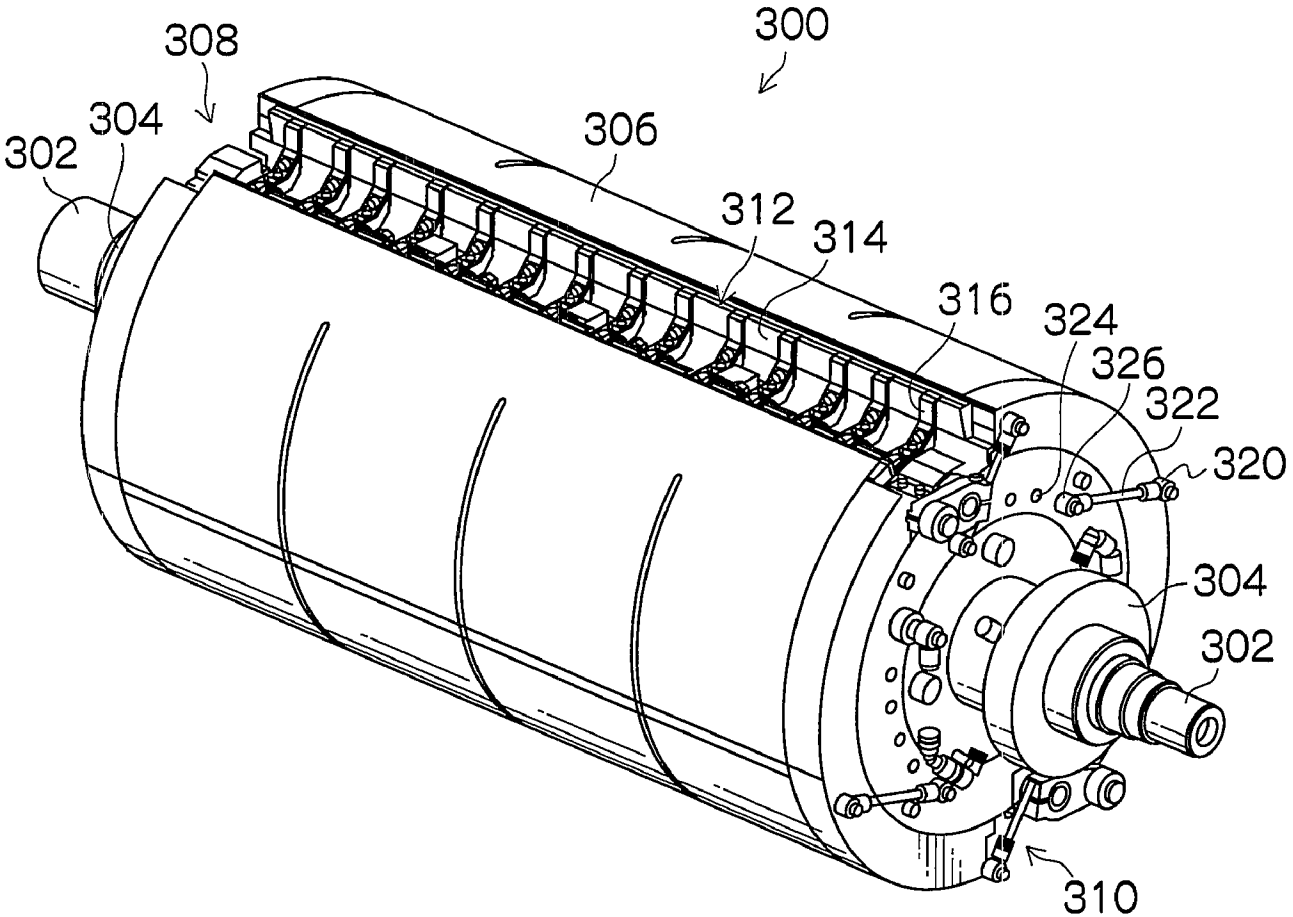
FIG. 7 is a perspective diagram showing the approximate structure of a conveyance drum.

FIG. 7 is an oblique diagram of the conveyance drum 300 according to the present embodiment. As shown in FIG. 7, the conveyance drum 300 has a cylindrical (drum) shape, and a rotational axis 302 thereof is supported on a bearing 304 at either end in the lengthwise direction; by rotating the rotational axis 302, the recording medium which is held on the outer circumferential surface 306 is conveyed in a prescribed direction.

A plurality of recess sections are provided in the outer circumferential surface 306 of the conveyance drum 300, and an end holding section which holds and fixes the leading end portion of the recording medium is provided in each recess section. FIG. 7 shows an example of a mode where two recess sections 308 and 310 are provided at symmetrical positions on either side of the rotational axis of the conveyance drum 300. It is also possible to adopt a mode where three recess sections are provided at three equidistant positions on the outer circumferential surface (positions whereby the angle formed between the respective recess sections is 120°), as in the pressure drum 126*c* of the print unit 108 shown in FIG. 1. In the mode shown in FIG. 7, the leading end portion of the recording medium 114 is held at two positions on each of the transfer drums 124*a* to 124*d*, a transfer structure for transferring the recording medium 114 from the pressure drum on the upstream side to the pressure drum on the downstream side is also provided, and a composition is adopted in which, when the transfer drums 124*a* to 124*d* perform one revolution, the pressure drums 126*a*, 126*b* and 126*d* perform ½ a revolution, the pressure drum 126*c* performs ⅓ a revolution, and the recording medium 114 is successively transferred.

Next, the structure of the recess sections 308 and 310 will be described. The internal structures of the recess section 308 and the recess section 310 are the same, and here only the recess section 308 is described, while description of the recess section 310 is omitted.

A paper leading end guide 314 having an end fixing surface 312 which fixes the leading end of the recording medium (see FIG. 1) is arranged following the lengthwise direction of the conveyance drum 300 in the recess section 308, and furthermore, a plurality of grippers 316 which grip and hold the leading end portion of the recording medium between themselves and the end fixing surface 312 of the paper leading end guide 314 are provided at prescribed intervals (equidistant intervals in the example in FIG. 7) in the lengthwise direction of the conveyance drum 300.

A plurality of suction holes 450 (shown in FIG. 16) are arranged in a prescribed arrangement pattern in a recording medium holding region where the recording medium is held on the outer circumferential surface 306 of the conveyance drum 300. The suction holes 450 are connected to a vacuum flow channel arranged inside the conveyance drum 300 (details shown in FIG. 16), and this vacuum flow channel is connected to a coupling section 320 provided on the side surface portion of the conveyance drum 300, suction hoses 322, coupling sections 326 provided on the side face of a manifold 324, and a vacuum flow channel (not shown) arranged inside the manifold 324. The vacuum flow channel inside the manifold 324 is connected to the vacuum pump 196 (see FIG. 5) which is external to the conveyance drum 300.

By driving the vacuum pump and generating a negative pressure in the suction holes of the outer circumferential surface 306 through the vacuum flow channel inside the conveyance drum 300 described above, it is possible to hold the recording medium by vacuum pressure onto the outer circumferential surface 306 of the recording medium holding region 414. The structure of the vacuum flow channel inside the conveyance drum 300 is described in detail below.

Figure 8:
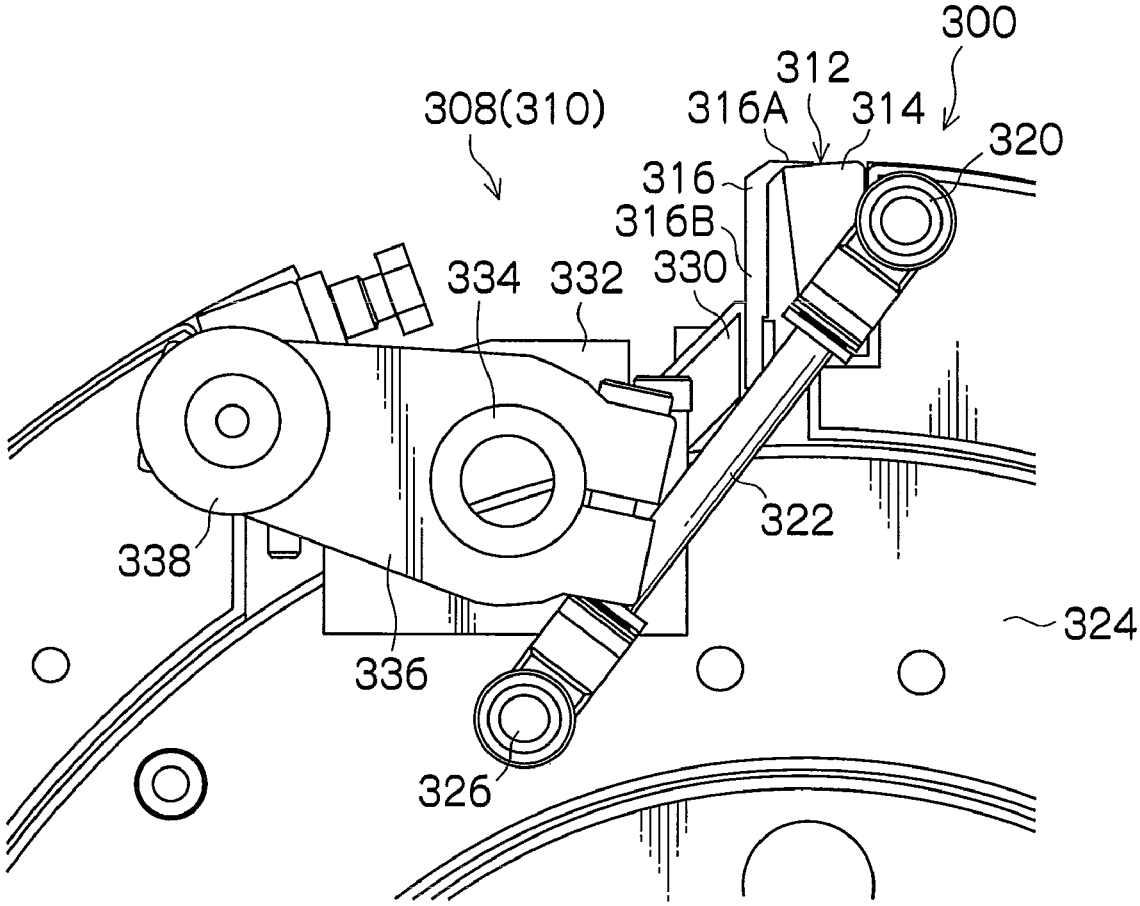
FIG. 8 is a partial enlarged view of FIG. 7.

FIG. 8 shows an enlarged view of the vicinity of the recess section 308 when the conveyance drum 300 is viewed from the side surface. As shown in FIG. 8, the gripper 316 holding the leading end portion of the recording medium has an approximate L shape and fixes the leading end portion of the recording medium by means of a hook 316A at the end of the gripper 316.

A straight section (perpendicular portion) 316B of the gripper 316 is supported by a gripper base 330, and furthermore, the gripper base 330 is connected to an opening and closing shaft 334, which is supported rotatably on a shaft bracket 332. The opening and closing shaft 334 is coupled to a cam follower 338 through an opening and closing arm 336.

The gripper 316 is constituted so as to make contact with and separate from an end fixing surface 312 (to perform an opening and closing operation), in accordance with the driving of a cam (not shown), by means of a transmission mechanism having the composition described above.

Description of Structure of Paper Leading End Guide

Figure 9:
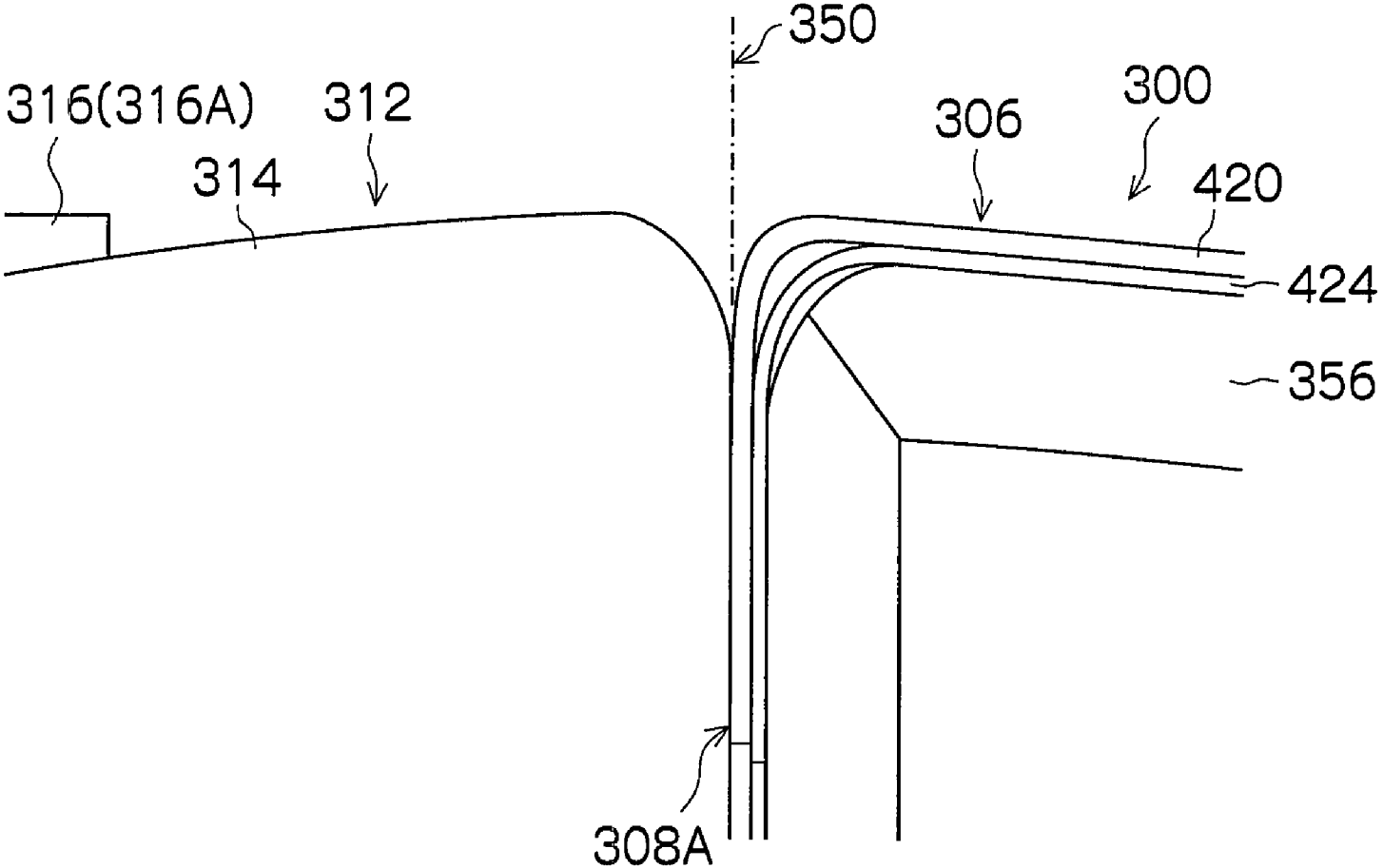
FIG. 9 is a partial enlarged view of FIG. 8.

Next, the paper leading end guide 314 will be described in detail. FIG. 9 is a diagram showing an enlarged view of the vicinity of the point of contact (boundary position) 350 (depicted by a single-dotted line) between the outer circumferential surface of the conveyance drum 300 and the paper leading end guide 314.

As shown in FIG. 9, the paper leading end guide 314 is arranged so as to contact the inner wall surface 308A of the recess section 308 (310) of the conveyance drum 300, and functions as a structure that grips the suction sheet 420 and the intermediate sheet 424, which are wound about the outer circumferential surface 306 of the conveyance drum 300, between itself and the main body section 356.

The paper leading end guide 314 is arranged at a position so that, when the recording medium is held on the outer circumferential surface 306 of the conveyance drum 300, the upper surface of the gripper 316 in a state of gripping the recording medium does not protrude from the image forming surface of the recording medium.

More specifically, taking the radius of the outer circumferential surface of the conveyance drum 300 as $R_d$ (see FIG. 10) and taking the thickness of the recording medium as t, the gripper 316 in a state of holding the recording medium is positioned inside a circle of radius ($R_d$+t) from the axis of rotation of the conveyance drum 300 (see FIG. 7), and is positioned at a prescribed distance to the inner side of the boundary position 350.

Furthermore, the end fixing surface 312 (curved surface), which has a radius of curvature of $R_1$ ($<R_d$), is arranged between the boundary position 350 between the outer circumferential surface 306 of the conveyance drum 300 and the paper leading end guide 314, and the position where the front end portion of the recording medium is fixed and held.

The distance between the boundary position 350 and the front end portion of the gripper 316 is determined appropriately on the basis of conditions whereby the whole of the gripper 316 is disposed to the inside of the recording medium.

The radius of curvature $R_1$ of the end fixing surface 312 of the paper leading end guide 314 is smaller than the radius $R_d$ of the outer circumferential surface of the conveyance drum 300, and the tangential direction at the boundary position 350 of the end fixing surface 312 is approximately the same direction as the tangential direction at the boundary position 350 of the outer circumferential surface 306 of the conveyance drum 300.

As shown in FIG. 9, at the boundary position 350 between the conveyance drum 300 and the paper leading end guide 314, the conveyance drum 300 and the paper leading end guide 314 are formed with chamfered shapes (namely, radius or curve processing of 1 mm to approximately several mm, or the like; in FIG. 9, the paper leading end guide 314 is chamfered with a radius of 2 mm, and the conveyance drum 300 is chamfered with a radius of 1 mm). This chamfering process is performed appropriately with no relation to the shape of the paper leading end guide 314 (end fixing surface 312).

Figure 10:
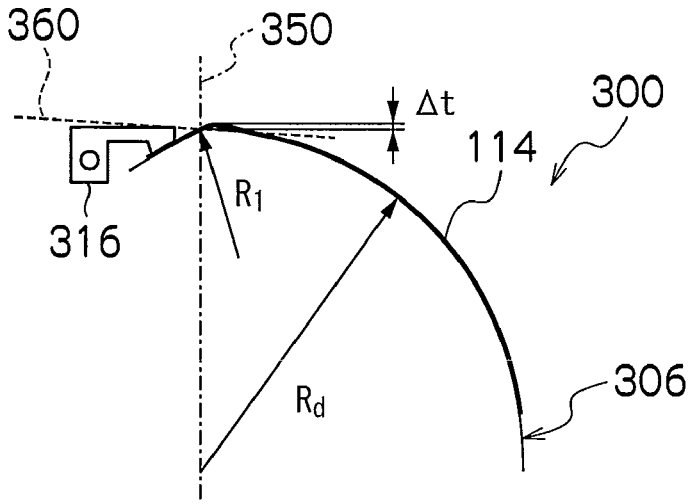
FIG. 10 is an explanatory diagram of the amount of lifting of the recording medium.

FIG. 10 is a schematic drawing of a state where the recording medium 114 is being held. As shown in FIG. 10, the radius $R_d$ of the conveyance drum 300 and the radius of curvature $R_1$ of the end portion fixing surface 312 satisfy the relationship $R_d>R_1$, and at the boundary position 350, the tangential direction of the outer circumferential surface 306 of the conveyance drum 300 is substantially the same with the tangential direction of the end portion fixing surface 312. In FIG. 10, at the boundary position 350, the tangential direction of the outer circumferential surface 306 of the conveyance drum 300 and the tangential direction of the end portion fixing surface 312 are the same with each other, and these directions are denoted with reference numeral 360.

FIG. 10 shows the case where the tangential direction of the outer circumferential surface 306 of the conveyance drum 300 is the same with the tangential direction of the end portion fixing surface 312 at the boundary position 350; however, it is sufficient for the angle (angular difference) formed between the tangential direction of the outer circumferential surface 306 of the conveyance drum 300 and the tangential direction of the end portion fixing surface 312 at the boundary position 350 to be 5°. In other words, description of the tangential directions being substantially the same is a concept which includes a case where the angle of difference between the two tangential directions is 5° or less.

In the fixing and holding structure of the recording medium 114 shown in FIGS. 9 and 10, when the thickness of the recording medium 114 is 0.04 mm to 0.2 mm, it is possible to keep the amount of lifting Δt to 1 mm or lower. In other words, the radius of curvature $R_1$ of the end fixing surface 312 of the paper leading end guide 314 is determined in such a manner that the amount of lifting Δt of the recording medium 114 is kept to 1 mm or lower when the front end portion of the recording medium 114 is held to the inner side of the outer circumferential surface 306 of the conveyance drum 300.

Figure 11:
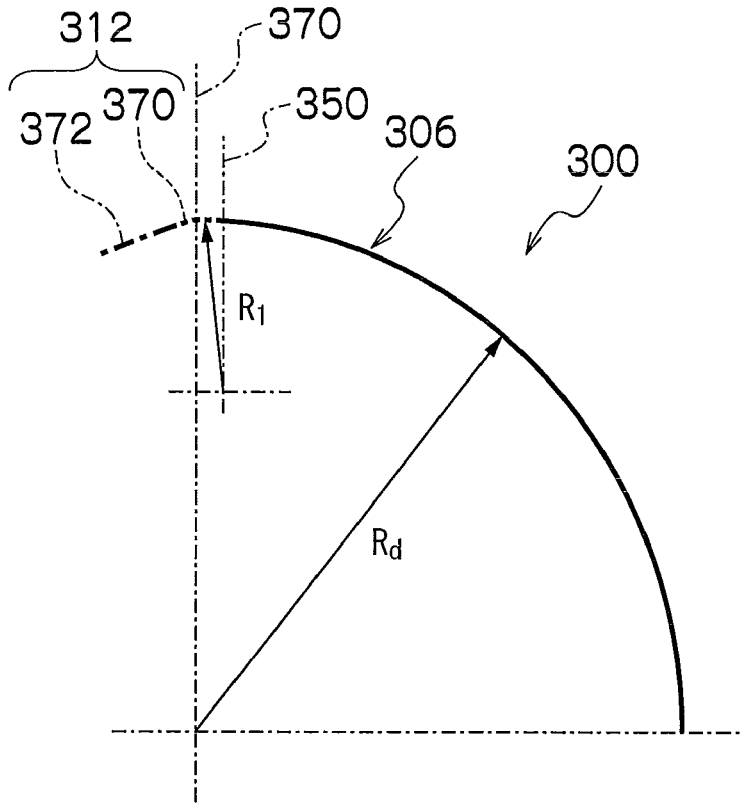
FIG. 11 is a schematic drawing showing a further mode of the fixing and holding surface shown in FIG. 10.

As shown in FIG. 11, a desirable mode is one in which the end portion fixing surface 312 is constituted of a curved surface section 370 and a flat surface section 372, and the leading end portion of the recording medium (not shown in FIG. 11; see FIG. 10) is gripped in the flat surface section 372.

In the mode shown in FIG. 11, the curved surface section 370 having the radius of curvature $R_1$ is arranged on the outer circumferential surface 306 side of the conveyance drum 300 (the upstream side in terms of the recording medium conveyance direction when the leading end portion of the recording medium is gripped), and the flat surface section 372 is arranged on the inner side of the recess section 308 (310) (on the downstream side in terms of the recording medium conveyance direction when the leading end portion of the recording medium is gripped). Furthermore, the gradient of the flat surface section 372 is approximately the same (angular difference of 50 or less) as the tangential direction at the boundary position 374 between the curved surface section 370 and the flat surface section 372. According to the structure shown in FIG. 11, the recording medium and the gripper make surface-to-surface contact, and it is possible further to increase the recording medium holding force and therefore the reliability of holding the recording medium is improved.

Figure 12:
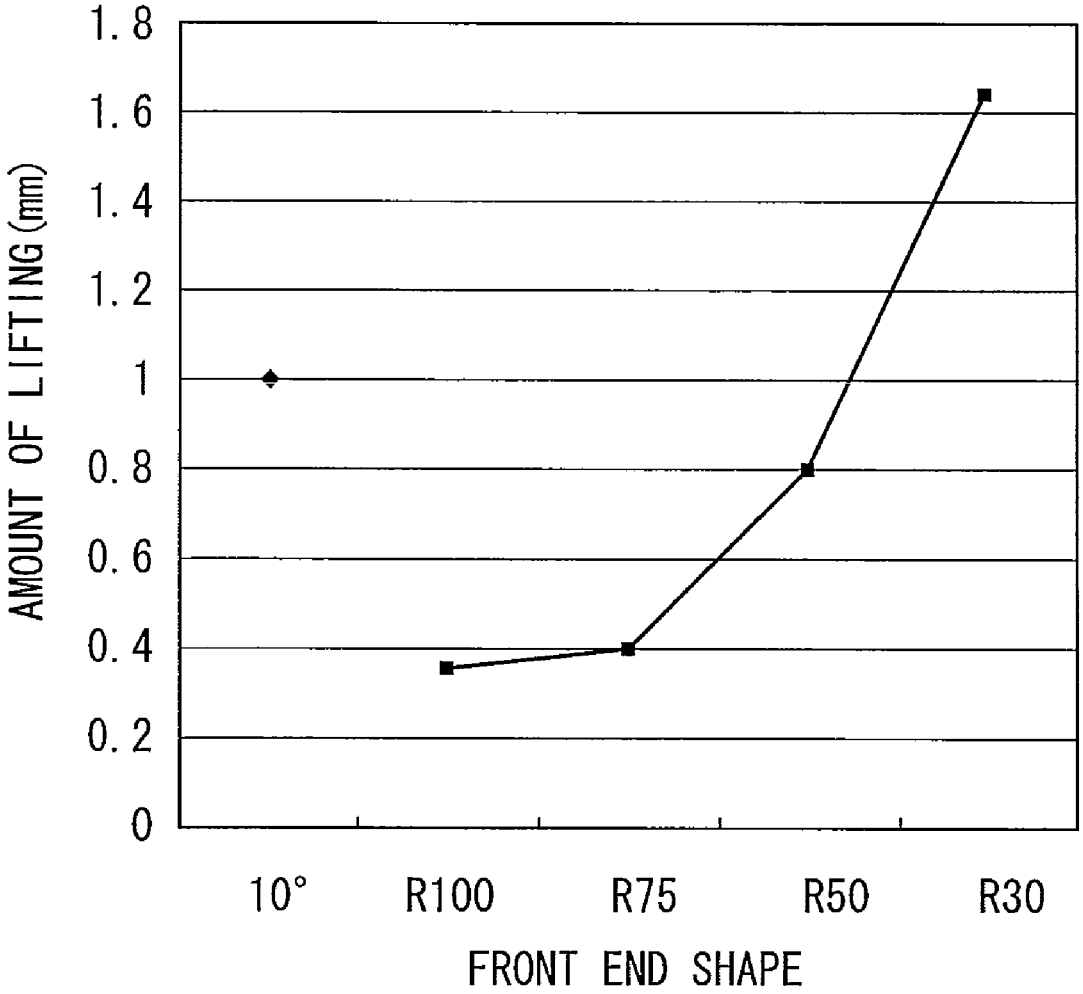
FIG. 12 is a diagram for describing the relationship between front end shape and the amount of lifting.

FIG. 12 shows the relationship between the amount of lifting (Δt) of the recording medium 114 shown in FIG. 10, and the shape (front end shape) of the end portion fixing surface 312 shown in FIGS. 8 and 9. In an evaluation experiment for determining the evaluation results shown in FIG. 12, the radius $R_d$ of the conveyance drum 300 was 225 mm, and the recording medium 114 was pressed appropriately in order to be able to stably measure the amount of lifting Δt of the recording medium 114. The recording medium 114 used was "Special Art Post N 186 g/m$^2$" (tradename, made by Mitsubishi Paper Mills) having a thickness of 0.17 mm.

Figure 22:
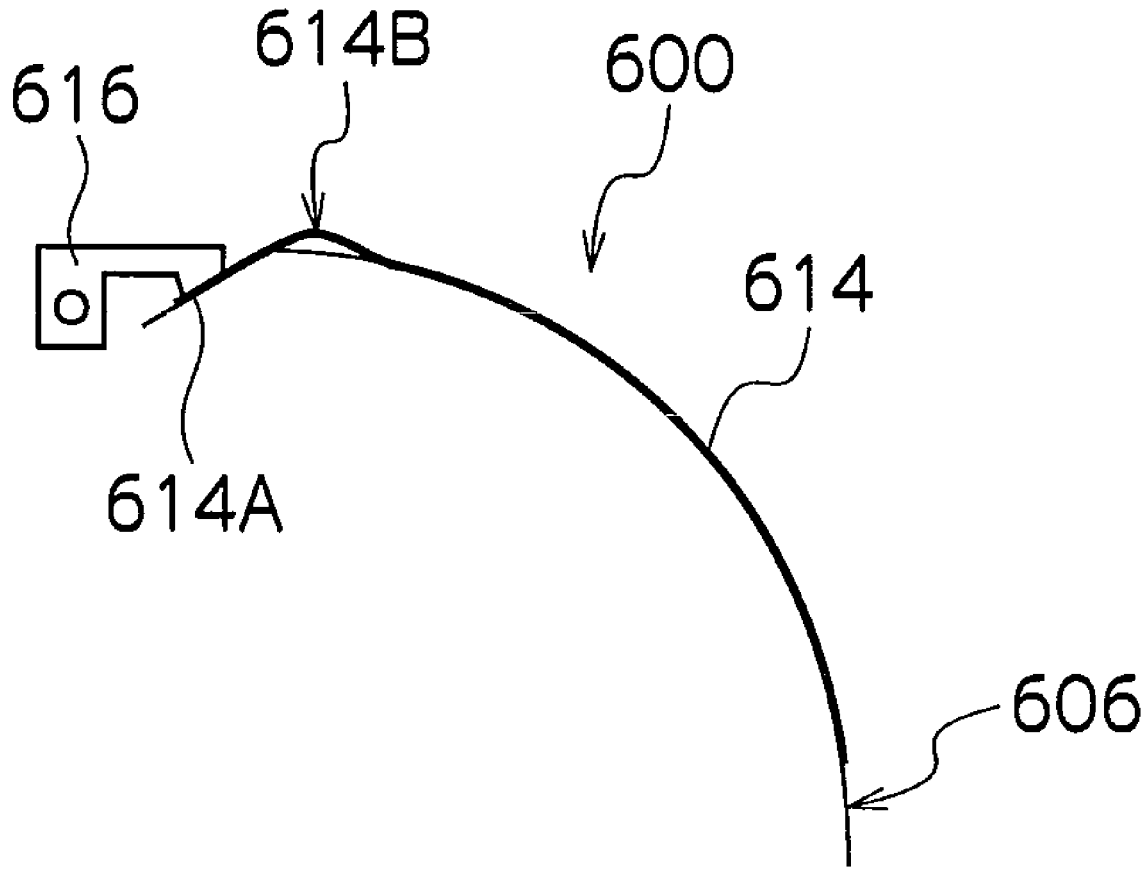
FIG.22 RELATED ART
FIG. 22 is a diagram for describing the lifting up of a recording medium in a drum conveyance method in the related art.

The fact that the front end shape is 10° in FIG. 12 means that when the leading end portion of the recording medium 114 is fixed and held on the flat surface section provided to the inner side of the outer circumferential surface 306 of the conveyance drum 300, then the angular difference between the flat surface section and the tangential direction of the outer circumferential surface 306 of the conveyance drum 300 at the boundary surface between the flat surface section and the outer circumferential surface 306 of the conveyance drum 300 is 10°. For instance, it is considered that the structure in the related art shown in FIG. 22 employs a structure of this kind.

If the structure in the related art having the angular difference of 10° is employed, then the amount of lifting Δt of the recording medium 114 is 1 mm, and taking account of manufacturing variations in the conveyance drum 300 and variations in the thickness of the recording medium 114, the amount of lifting Δt is predicted to exceed 1 mm.

Consequently, the clearance between the image forming surface of the recording medium 114 and the head 160 in a state where the recording medium 114 lies in tight contact with the outer circumferential surface 306 of the conveyance drum 300 must be 1.0 mm plus a sufficient margin.

On the other hand, when the recording medium 114 is fixed and held by the structure according to the embodiment of the present invention as shown in FIGS. 9 to 11, if the radius of curvature $R_1$ of the end portion fixing surface 312 shown in FIG. 10 is not smaller than 50 mm, then it is sufficiently possible to achieve a clearance of 1.0 mm between the image forming surface of the recording medium 114 and the head 160, and furthermore, it is possible to make the clearance less than 1.0 mm.

Although the amount of lifting Δt of the recording medium 114 shown in FIG. 12 changes according to the conditions such as the type and thickness of the recording medium 114, it is estimated that substantially the same tendency is displayed (the shape of the graph in FIG. 12 is substantially the same, and is shifted in the upward or downward direction). This evaluation experiment employed conditions which produce a large amount of lifting, by using strong and relatively thick art paper, and therefore even if the conditions are changed, such as the recording medium which might be envisaged in the present invention, it is estimated that evaluation results shifted downwards from the graph in FIG. 12 will be obtained.

To give a specific example of the dimensions of the conveyance drum 300 and the paper leading end guide 314 shown in FIGS. 9 and 10, the radius $R_d$ of the conveyance drum 300 is 225 mm and the radius of curvature $R_1$ of the end fixing surface 312 is 75 mm. When the radius $R_d$ of the conveyance drum 300 satisfies "150 mm<$R_d$<1000 mm", the radius of curvature $R_1$ of the end fixing surface 312 satisfies "50 mm<$R_1$<200 mm (where $R_d$>$R_1$)".

The inkjet recording apparatus 100 (200) having the composition described above is provided with the paper leading end guide 314 for fixing and holding the leading end portion of the recording medium 114 on the inner side of the outer circumferential surface 306 of the conveyance drum 300 (the pressure drums 126*a* to 126*d*), which conveys the recording medium 114, the gripper 316, which grips the leading end portion of the recording medium 114 from either side between itself and the end portion fixing surface 312 of the paper leading end guide 314, and an opening and closing mechanism of the gripper 316.

By providing the region (end portion fixing surface 312) having the radius of curvature $R_1$ that is smaller than the radius $R_d$ of the outer circumferential surface 306 of the conveyance drum 300 between the outer circumferential surface of the conveyance drum 300 and the section where the leading end portion of the recording medium 114 is held, the bent portion of the recording medium 114 (the portion where the recording medium 114 is bent to the inner side of the conveyance drum 300) is prevented from lifting up and producing a crease by folding, and jamming of the recording medium 114, damaging of the head 160 due to contact between the recording medium 114 and the head 160, and decline in image quality, are also prevented.

Furthermore, it is possible to reliably hold the leading end portion of the recording medium 114 by means of a structure which grips the leading end portion of the recording medium 114 between the end portion fixing surface 312 and the gripper 316.

The present embodiment describes a mode where the leading end portion of the recording medium 114 is gripped; however, it is also possible to grip the trailing end potion of the recording medium 114.

First Modification Embodiment

Figure 13:
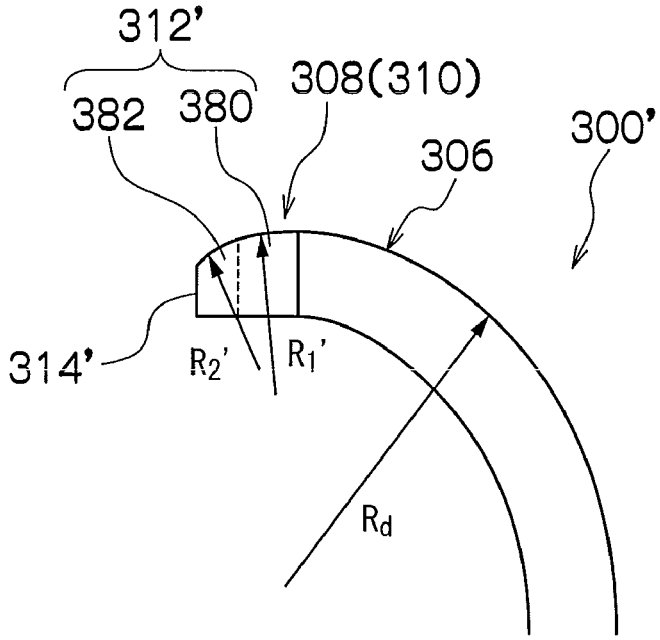
FIG. 13 is a schematic drawing showing a modification embodiment of the present invention.

Next, a first modification embodiment of the present invention will be described. FIG. 13 shows a schematic drawing of the structure of a conveyance drum 300' according to the first modification embodiment.

An end portion fixing surface 312' shown in FIG. 13 is constituted of a curved surface 380 having the radius of curvature $R_1'$ and a curved surface 382 having the radius of curvature $R_2'$, and the radius $R_d$ of the outer circumferential surface 306 of the conveyance drum 300', the radius of curvature $R_1'$ of the curved surface 380 and the radius of curvature $R_2'$ of the curved surface 382 satisfy the relationship $R_d$>$R_1'$>$R_2'$.

In other words, the end portion fixing surface 312' of the paper leading end guide 314' according to the first modification embodiment has the plurality of curved surfaces, and the curved surfaces have shapes whereby the radius of curvature declines gradually from the side of the outer circumferential surface 306 of the conveyance drum 300' (the upstream side in terms of the conveyance direction of the recording medium when the leading end portion of the recording medium is gripped) toward the leading end holding portion (the position of the gripper 316 shown in FIG. 9, which is on the downstream side in terms of the conveyance direction of the recording medium when the leading end portion of the recording medium is gripped).

The relationship between the radius of curvature $R_1'$ of the curved surface 380 and the radius of curvature $R_2'$ of the curved surface 382 may be $R_2'$>$R_1'$. Furthermore, similarly to the mode shown in FIG. 11, it is also possible for the leading end holding section, which is one portion of the end portion fixing surface 312' (a portion of the curved surface 382), to be formed as a flat surface section, and for the leading end portion of the recording medium 114 to be gripped by this flat surface section.

To give a specific example of the dimensions of the conveyance drum 300' shown in FIG. 13, $R_d$=225 mm, $R_1'$=100 mm and $R_2'$=75 mm.

Second Modification Embodiment

Figure 14:
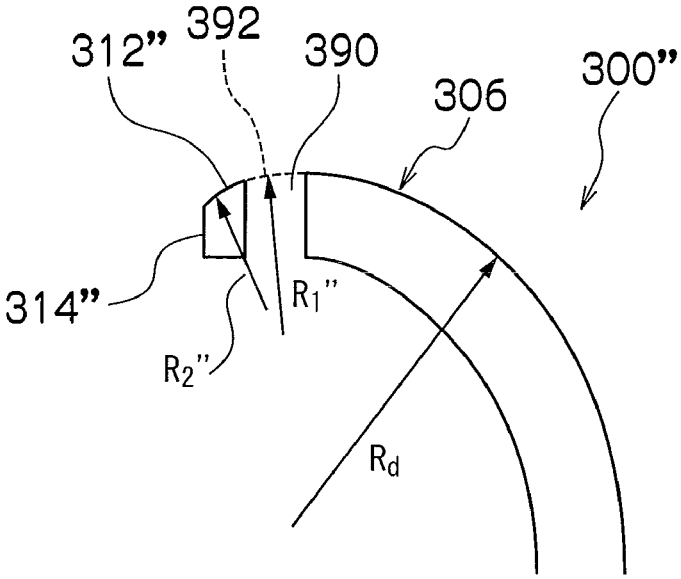
FIG. 14 is a schematic drawing showing a further modification embodiment of the present invention.

Next, a second modification embodiment of the present invention will be described. FIG. 14 shows a schematic drawing of the structure of a conveyance drum 300" according to the second modification embodiment.

As shown in FIG. 14, a gap 390 is provided between the outer circumferential surface 306 of the conveyance drum 300" and a paper leading end guide 314". Assuming that a virtual outer circumferential surface 392 (indicated with the dashed lines) exists in this gap 390, then the radius $R_d$ of the outer circumferential surface 306 of the conveyance drum 300", the radius of curvature $R_1''$ of the virtual outer circumferential surface 392 of the gap 390, and the radius of curvature $R_2''$ of the end fixing surface 312" satisfy the relationship $R_d$>$R_1''$>$R_2''$, the tangential direction of the outer circumferential surface 306 of the conveyance drum 300" at the boundary position between the gap 390 and the outer circumferential surface 306 of the conveyance drum 300" is substantially the same with (has an angular difference of 5° or less with respect to) the tangential direction of the virtual outer circumferential surface 392 in the gap 390, and the tangential direction of the virtual outer circumferential surface 392 in the gap 390 at the boundary position between the gap 390 and the paper leading end guide 314 is substantially the same with (has an angular difference of 5° or less with respect to) the tangential direction of the end fixing surface 312" of the paper end guide 314".

In other words, this structure is equivalent to a structure in which the curved surface 380 in the first modification embodiment shown in FIG. 13 is substituted with the gap 390 shown in FIG. 14. More specifically, a structure is adopted in which at least one curved surface (380, 382) having a radius of curvature which is smaller than the radius of the outer circumferential surface 306 of the conveyance drum 300' (300") is provided between the outer circumferential surface 306 of the conveyance drum 300' (300") and the part that holds the leading end portion of the recording medium 114 (the position of the front end portion of the gripper 316 in FIG. 9), and the tangential direction of the outer circumferential surface 306 of the conveyance drum 300' (300") at the boundary position between the curved surface 380 and the outer circumferential surface 306 of the conveyance drum 300' (300") is substantially the same with the tangential direction of the curved surface 380, and if there are a plurality of curved surfaces 380 and 382, then the curved surface 380 that is adjacent to the outer circumferential surface 306 of the conveyance drum 300' (300") can be substituted with the gap 390.

Description of Vacuum Flow Channel of Pressure Drum (Conveyance Drum)

Figure 15:
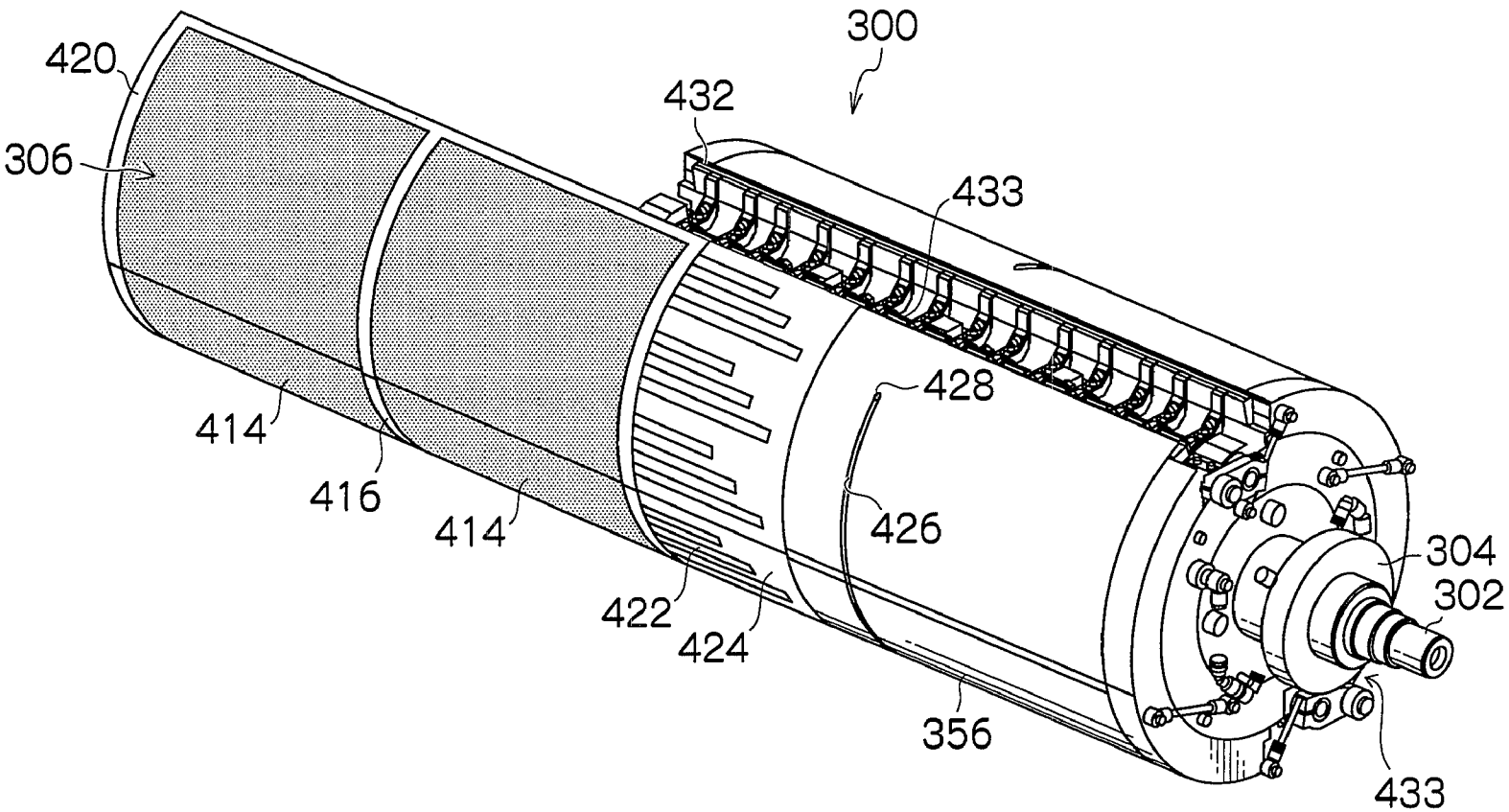
FIG. 15 is an exploded perspective diagram showing the internal structure of the conveyance drum shown in FIG. 7.

Next, the structure of the vacuum flow channel of the conveyance drum 300 will be described. FIG. 15 is an exploded perspective diagram of the conveyance drum 300. In FIG. 15, parts which are the same as or similar to those in FIGS. 1 to 14 are denoted with the same reference numerals and further explanation thereof is omitted here.

The conveyance drum 300 is provided with recording medium holding regions 414 (the dot-hatched regions in FIG. 15) on the recording medium holding surface (circumferential surface) 306 on which the recording medium 114 is held (and fixed), and a plurality of suction holes 450 (openings; shown in FIG. 16) are provided in the recording medium holding regions 414. On the other hand, the approximate central portion in the axial direction of the conveyance drum 300 forms a closing section 416 where no suction holes are provided throughout the whole perimeter in the circumferential direction.

A vacuum flow channel which is connected to the suction holes is arranged inside the conveyance drum 300, and the vacuum flow channel is connected to a vacuum pump arranged to the exterior of the conveyance drum 300 through a vacuum piping system (including pipes, joints, and the like) arranged on the side face of the conveyance drum 300 and a vacuum flow channel arranged inside the rotational axis of the conveyance drum 300. When a vacuum (negative pressure) is generated by driving the vacuum pump, a suction pressure is applied to the recording medium 114 through the suction holes, the vacuum flow channel, and the like. In other words, the conveyance drum 300 is composed in such a manner that the recording medium is held on the recording medium holding region 414 by air suction.

The conveyance drum 300 includes a suction sheet 420 in which a plurality of suction holes are arranged, and an intermediate sheet 424 in which a plurality of suction grooves 422 (flow channel forming sections having openings), which are connected to the suction holes, are arranged in accordance with a prescribed arrangement pattern, and a main body section 356 having a drum suction groove 426, which is connected to restrictor sections 434 (shown in FIG. 16) provided in the respective suction grooves 422.

Furthermore, a drum suction hole 428, which is connected to the vacuum flow channel (not shown) arranged inside the main body section 356, is arranged in the end portion of the drum suction groove 426, which is arranged on the main body section 356.

As shown in FIG. 15, the conveyance drum 300 has a structure in which the drum suction groove 426 of the main body section 356 and the restrictor sections of the intermediate sheet 424 are aligned in position and the intermediate sheet 424 is wrapped about the circumferential surface of the main body section 356 and fixed in tight contact with same, and furthermore, the suction grooves 422 of the intermediate sheet 424 are aligned in position with the suction holes of the suction sheet 420 in such a manner that the suction holes provided in the suction sheet 420 connect with the suction grooves 422 of the intermediate sheet 424, and the suction sheet 420 is wrapped over the intermediate sheet 424 and fixed in tight contact with same.

Desirably, the arrangement pattern of the suction holes provided in the suction sheet 420 corresponds to the pattern of the suction grooves 422 in the intermediate sheet 424. Some of the suction holes may not be connected to the suction grooves 422.

Figure 16:
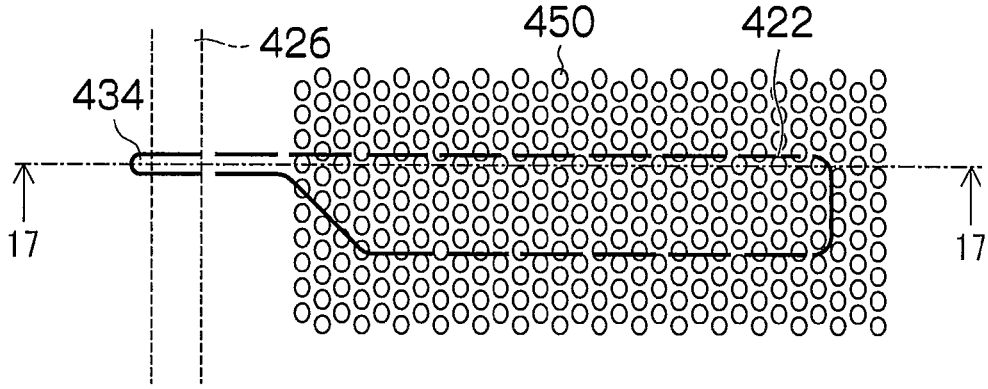
FIG. 16 is a partially enlarged diagram of the suction sheet shown in FIG. 15.
Figure 17:
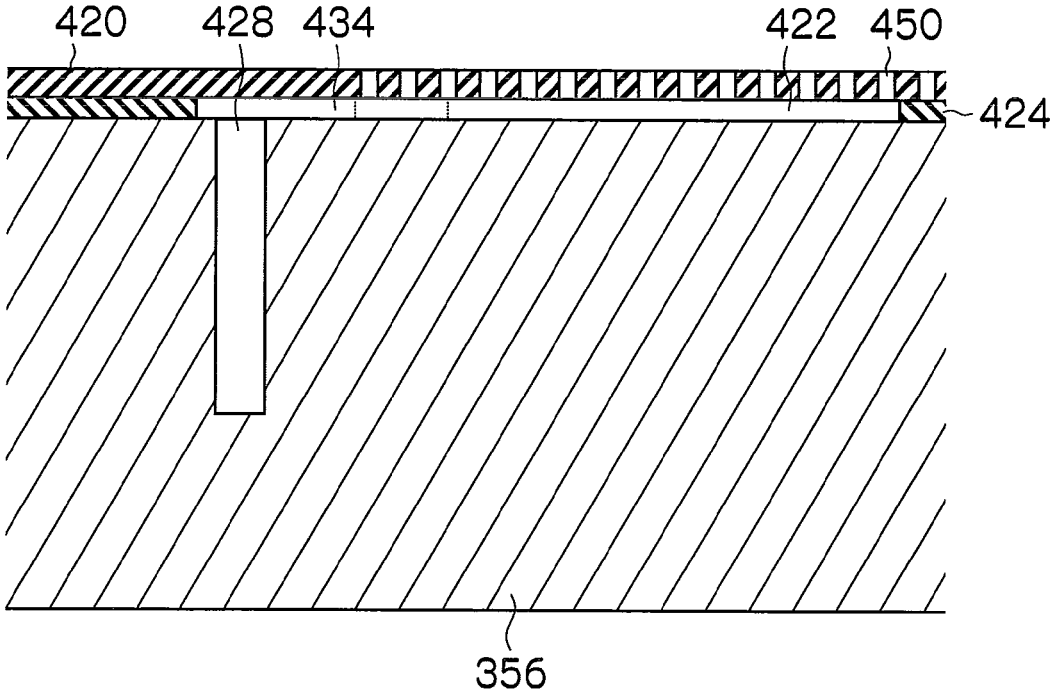
FIG. 17 is a cross-sectional diagram along line 17-17 in FIG. 16.

FIGS. 16 and 17 illustrate the arrangement relationship between the suction holes 450, the suction grooves 422 and the drum suction groove 426, and the drum suction hole 428.

FIG. 16 is a plan diagram viewed from the side of the outer circumferential surface of the conveyance drum, and FIG. 17 is a cross-sectional diagram along line 17-17 in FIG. 16. FIG. 17 illustrates an enlarged view in the depth direction in order to aid understanding.

As shown in FIG. 16, the width of the suction groove 422 (the length in the vertical direction in FIG. 16) covers some suction holes 450, and FIG. 16 illustrates a mode where the width of the suction groove 422 is approximately four times the diameter of the suction hole 450 (the length in the direction of the longer axis).

Furthermore, the width of the drum suction groove 426 (the length in the horizontal direction in FIG. 16) is shorter than the length of the restrictor section 434, and FIG. 16 shows a mode where the width of the drum suction groove 426 is approximately ½ the length of the restrictor section 434. Moreover, the restrictor section 434 has a length which reaches a position surpassing the drum suction groove 426.

As shown in FIGS. 16 and 17, the width of the restrictor section 434 is narrower than the width of the suction grooves 422, and the restrictor sections 434 and the suction grooves 422 have substantially the same depth. Hence, the cross-sectional area of the restrictor section 434 is smaller than the cross-sectional area of the suction groove 422, and the flow rate in the suction groove 422 is restricted by such a structure of the restrictor section 434.

As shown in FIG. 17, the thickness of the suction sheet 420 is greater than the thickness of the intermediate sheet 424, and FIG. 17 shows a mode in which the thickness of the intermediate sheet 424 is approximately ½ compared to the thickness of the suction sheet 420.

Next, the structure of the main body section 356 will be described in detail with reference to FIG. 18.

The drum suction groove 426, which corresponds to the full circumference of the main body section 356, is provided on the outer circumferential surface 356A of the main body section 356 in the circumferential direction of the main body section 356, in the approximate central portion in the axial direction (the direction perpendicular to the circumferential direction (the direction of conveyance of the recording medium 114)).

Figure 18:
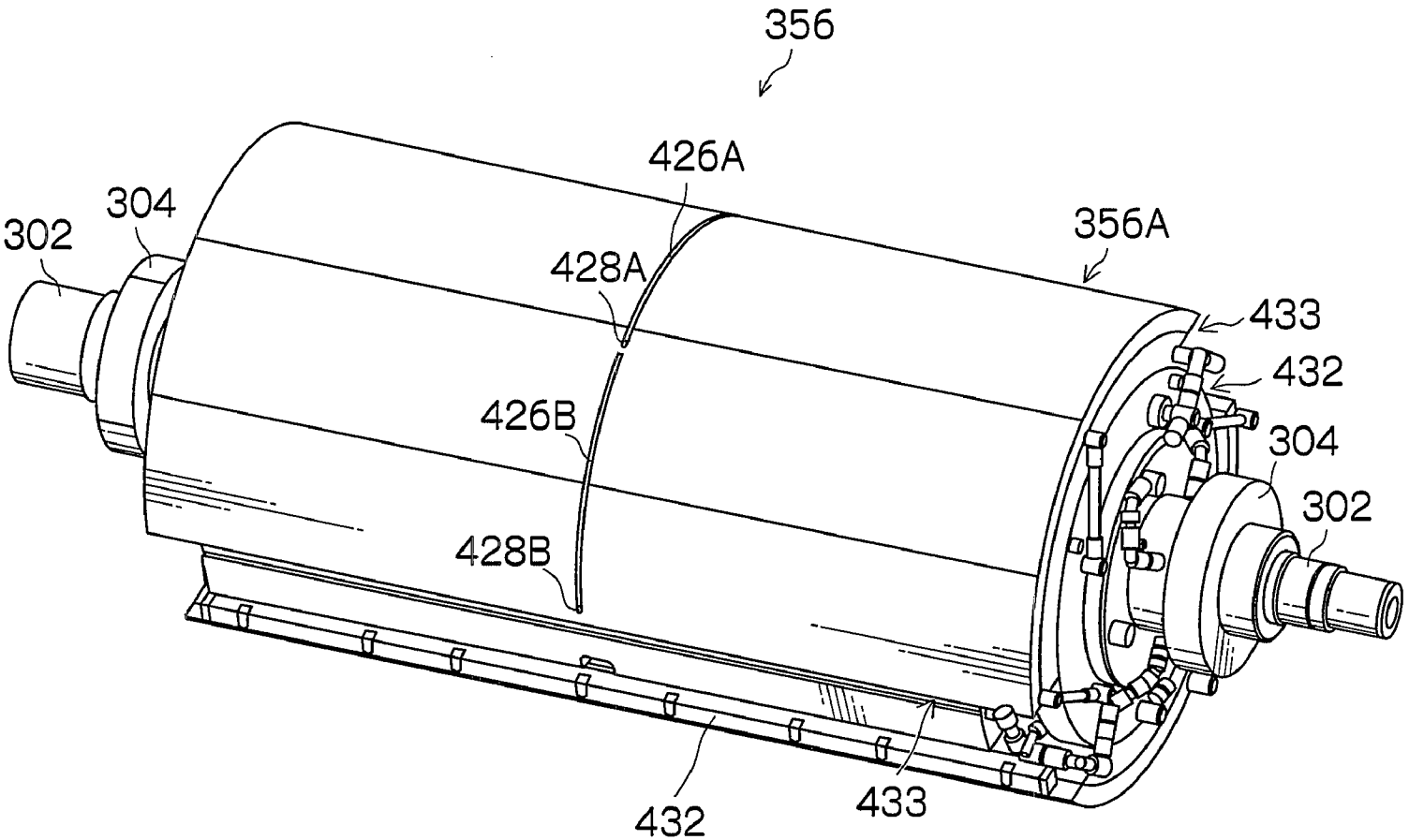
FIG. 18 is a perspective diagram showing the approximate structure of a drum main body shown in FIG. 7.

FIG. 18 shows a mode where two drum suction grooves 426A and 426B are provided in a half circumference (divided region) of the main body section 356 (i.e., the mode where four drum suction grooves 426 are provided in the whole circumference of the main body section 356); however, it is also possible to cover one half circumference of the main body section 356 with one drum suction groove or to cover one half circumference of the main body section 356 with three or more drum suction grooves. Depending on the required suction pressure and the capacity of the vacuum pump, it may be possible to cover one half circumference portion of the main body section 356 with a single drum suction groove. However, if the half circumference of the main body section 356 is covered with a single drum suction groove, then the number of suction grooves 422 (see FIGS. 7 and 8) in the intermediate sheet 424 that are connected to the single drum suction groove becomes large and the efficiency declines, and therefore it is desirable to adopt a structure in which the half circumference portion of the main body section 356 is covered by at least two drum suction grooves.

Drum suction holes 428A and 428B are provided in end sections of the respective drum suction grooves 426A and 426B, and the drum suction grooves 426A and 426B are respectively connected to the vacuum flow channel (see FIG. 17) which is provided inside the main body section 356 through the drum suction holes 428A and 428B. The vacuum flow channel is connected to the vacuum pump through the vacuum piping system arranged in the side face of the main body section 356 and the vacuum flow channel arranged inside the rotational axis 302.

The gripping structure 432, which grips a fold structure (L-shaped bend structure) provided on the intermediate sheet 424 or the suction sheet 420 when fixing the intermediate sheet 424 or the suction sheet 420, is provided on the outer circumferential surface 356A of the main body section 356, and furthermore, a tensioning mechanism 433, which applies a tension in the circumferential direction of the suction sheet 420 when the fold structure (L-shaped bend structure) of the suction sheet 420 is in a gripped state, is provided on the portion opposite to the gripping structure 432 across the main body section 356.

The gripping structure 432 and the tensioning mechanism 433 of the main body section 356 should have a structure which is capable of fixing the suction sheet 420 and the intermediate sheet 424 shown in FIG. 15 in a state of tight contact, and FIG. 18 omits the depiction of the detailed structure (the detailed structure is shown in FIG. 9).

In the conveyance drum 300 shown in the present embodiment, a prescribed suction channel is formed about the whole circumference of the conveyance drum 300 by arranging the two suction sheets 420 and the two intermediate sheets 424 in the circumferential direction, and therefore the gripping structures 432 and the tensioning mechanisms 433 described above are provided in two opposing positions in the circumferential direction.

Next, the structure of the intermediate sheet 424 will be described in detail.

Figure 19:
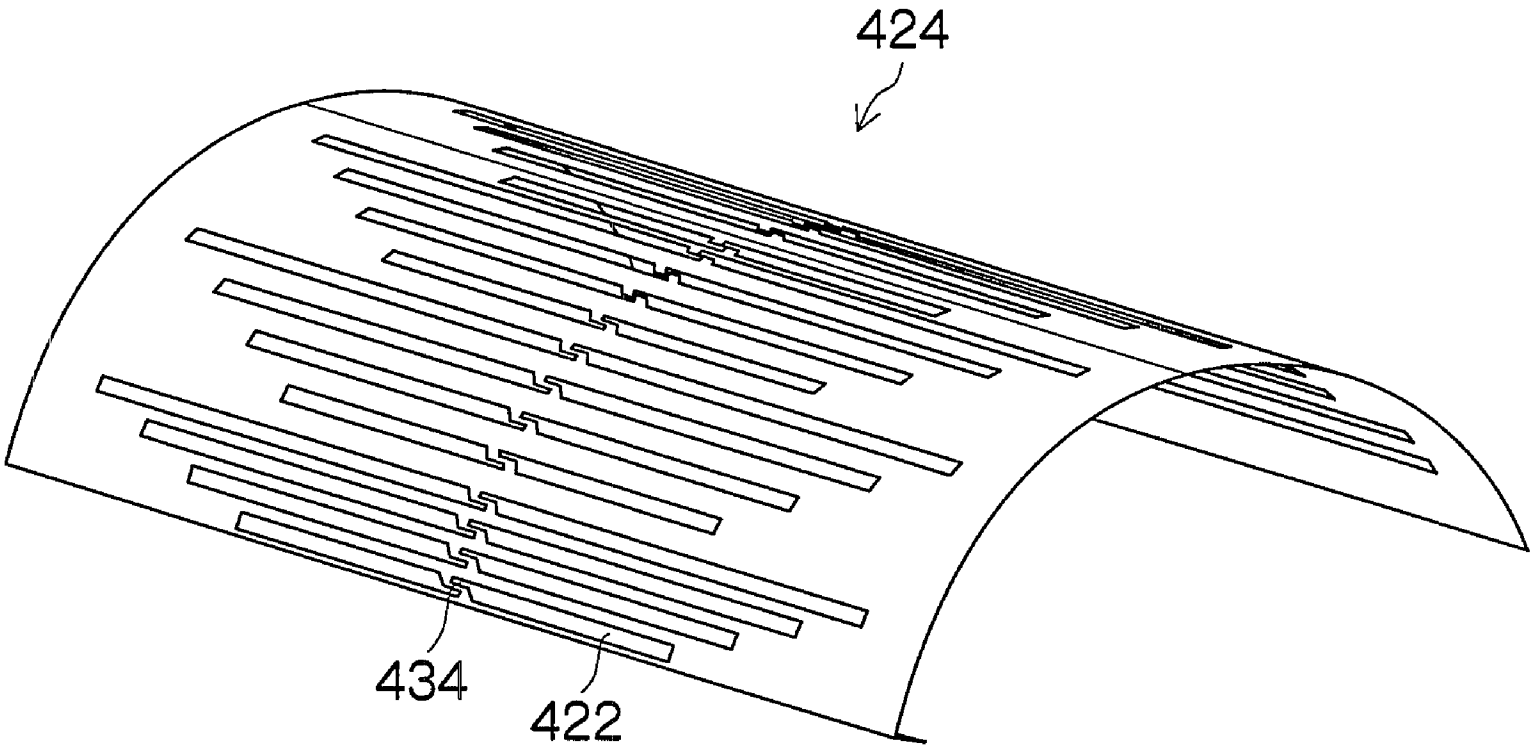
FIG. 19 is a perspective diagram showing the structure of the intermediate sheet shown in FIG. 15.

FIG. 19 is a perspective diagram of the intermediate sheet 424. As shown in FIG. 19, in the intermediate sheet 424, the suction grooves 422 leading from the approximate central portion towards the respective end portions in the axial direction of the conveyance drum 300 are arranged at equidistant intervals in a direction following the circumferential direction of the conveyance drum 300, in the axial direction of the conveyance drum 300 (see FIG. 15).

One end portion of the intermediate sheet 424 is formed with a fold structure (L-shaped bend structure) which is gripped by the gripping structure 432 of the main body section 356, and by gripping this fold structure with the gripper structure 432, the main body section 356 and the intermediate sheet 424 are registered in position and the end portion of the intermediate sheet 424 is fixed.

The other end portion of the intermediate sheet 424 has a straight structure and therefore can be made to conform to the curvature of the main body section 356 when the intermediate sheet 424 is placed in tight contact with the main body section 356.

The end portions of the suction grooves 422 on the central portion side of the intermediate sheet 424 have a narrowed structure in which the groove width is restricted to ¼ or less compared to the other portions of the grooves, thereby forming the restrictor sections 434 (see FIG. 16) passing through the intermediate sheet 424. The restrictor sections 434 have a structure in which the restrictor sections 434 are connected to the drum suction grooves 426A and 426B shown in FIG. 18 and the opening portions thereof are closed off by the closing portion 416 (see FIG. 7) of the suction sheet 420 and is not connected directly to the outside air.

Desirably, the groove width of each restrictor section 434 is not smaller than 0.2 mm and not larger than 3.0 mm, and more desirably, not smaller than 1.0 mm and not larger than 2.0 mm. Furthermore, it is desirable that the length of each restrictor section 434 in the axial direction is not smaller than 2.0 mm and not larger than 10.0 mm.

Moreover, it is desirable that the suction grooves 422 should be disposed as densely as possible, and a desirable mode is one in which the suction grooves corresponding to recording media of prescribed sizes are disposed at a pitch of 50 mm or less.

The suction grooves 422 provided in the intermediate sheet 424 have a length corresponding to the size of the recording media 114 used, and the suction grooves 422 of different lengths are provided so as to correspond to recording media of a plurality of sizes. For example, as an arrangement pattern of the suction grooves 422, a mode is possible in which the suction grooves 422 having four different lengths are arranged in a prescribed pattern (a pattern corresponding to the recording media 114 of the sizes used), in order to correspond to recording media 114 of at least five different sizes.

Examples of the applicable sizes of the recording media include quarter A size (312 nm×440 mm), quarter Shiroku size (394 mm×545 mm), half A size (440 mm×625 mm), half Kiku size (469 mm×636 mm) and half EU size (520 nm×720 mm).

If a quarter A size recording medium is used, then the recording medium 114 is disposed in accordance with the corresponding region, and the negative pressure generated in the suction grooves 422 disposed in this region principally acts to hold the recording medium 114 by suction, while the end portions and the vicinity of the end portions on the side opposite to the restrictor sections 434, of the suction grooves 422 which are disposed inside the region, as well as those suction grooves 422 which disposed outside this region are open to the air.

However, the restrictor sections 434 of the suction grooves 422 which are open to the air act so as to restrict the applied vacuum pressure (air flow rate), thereby avoiding suction pressure failures due to the occurrence of pressure loss in the suction grooves 422 which are open to the air. Consequently, it is possible to ensure the required suction pressure in the suction grooves 422 which suction the recording medium 114.

If a recording medium 114 of size other than quarter A size, quarter Shiroku size, half A size, half Kiku size, and half EU size is used, then it is also possible to respond accordingly by changing the shape of the openings (arrangement pattern) of the suction grooves 422 in the intermediate sheet 424. In other words, by preparing an intermediate sheet 424 with arrangement patterns of suction grooves 422 which correspond to recording media 114 of other sizes and replacing the intermediate sheet 424, then it is possible to respond accordingly to recording media 114 of various sizes. In other words, it is possible to achieve compatibility with a destination region by changing the intermediate sheet 424, rather than changing the conveyance drum 300.

Furthermore, by adopting an arrangement pattern of the suction grooves 422 in which the suction grooves 422 having different lengths are placed adjacently to each other, variation in the overall rigidity of the intermediate sheet 424 is suppressed and local deformation of the recording medium 114 is prevented. Since the corners of the trailing edge portion of the recording medium 114 are liable to float up, then it is desirable that the suction grooves 422 should be provided in positions right up until the edge portions of the recording medium 114.

The thinner the intermediate sheet 24, the greater the suction force that can be obtained with a small negative pressure, but if the intermediate sheet 24 is thin, then blockages caused by foreign matter, such as paper dust, dirt, mistakenly ejected ink droplets, or the like, become more liable to occur. These conditions are considered, then desirably, the thickness of the intermediate sheet 24 should be approximately 0.05 mm to 0.5 mm.

Next, the suction sheet 420 will be described in detail.

Figure 20:
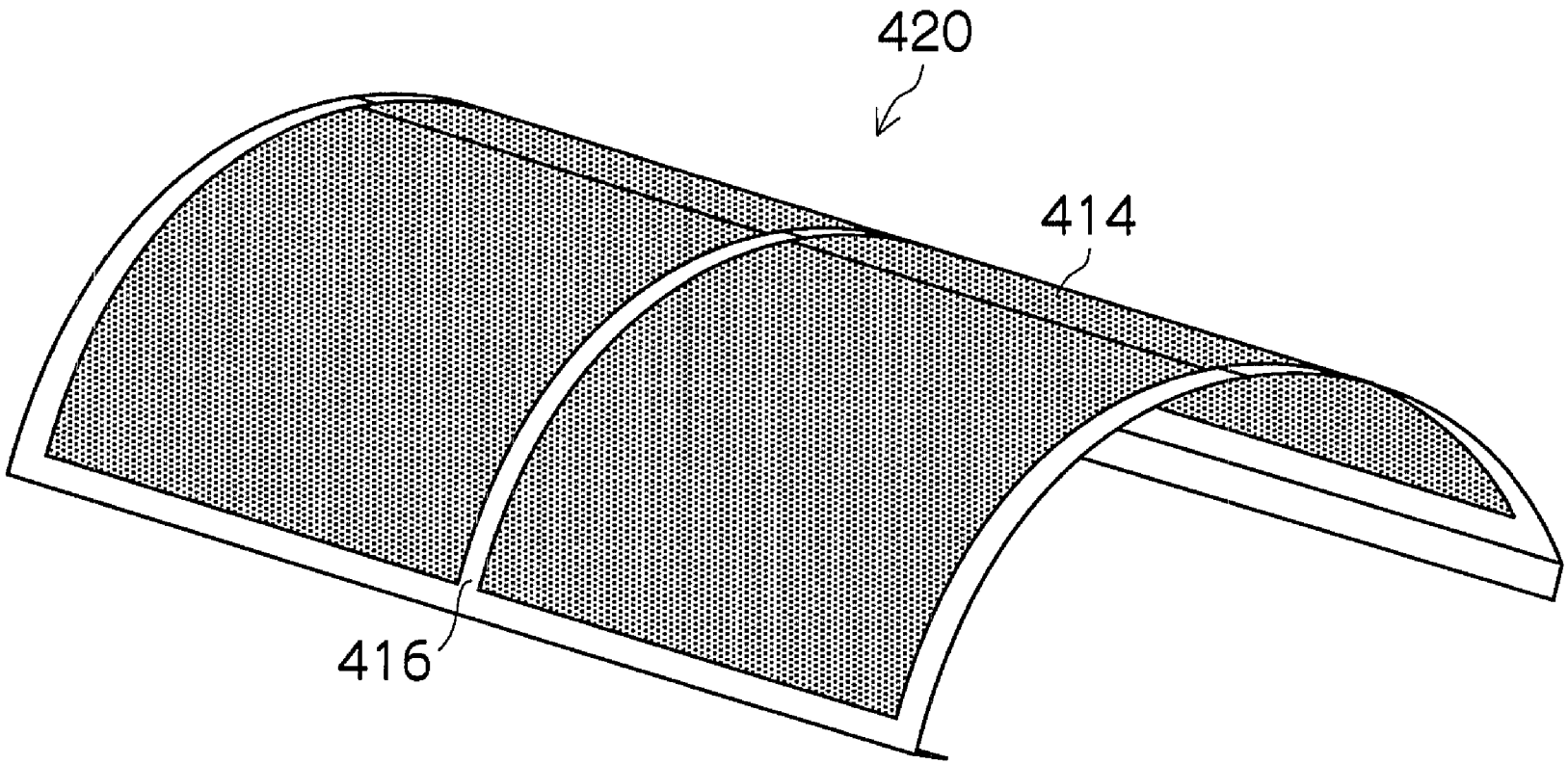
FIG. 20 is a perspective diagram showing the structure of the suction sheet shown in FIG. 15.

FIG. 20 is a perspective diagram of the suction sheet 420. As shown in FIG. 20, the suction holes (see FIG. 16) are arranged according to a prescribed arrangement pattern in the recording medium holding region 414 of the suction sheet 420. Furthermore, the approximate central portion of the suction sheet 420 in the axial direction of the conveyance drum 300 (see FIG. 15) forms the closing section 416 where no suction holes are provided. Moreover, either end of the suction sheet 420 in the circumferential direction of the conveyance drum 300 forms a fold structure (L-shaped bend structure) for fixing to the main body section 356 (see FIG. 18).

By not arranging suction holes in the portion of the suction sheet 420 so as to form the closing portion 416 that corresponds to the restrictor sections 434 of the intermediate sheet 424 (see FIG. 16), the function of restricting pressure loss in the restrictor sections 434 is ensured. Furthermore, by providing the large number of suction holes in the portion of the suction sheet 420 other than the closing portion 416, it is possible to achieve a suction sheet pattern of the same shape, without having to change the pattern of the suction holes in accordance with the compatible paper sizes.

In other words, even if some of the suction holes (and suction grooves 422; see FIG. 19) become opened to the air due to the size of the recording medium 114 used, it is still possible to restrict the loss of suction pressure due to the action of the restrictor sections 434, and therefore it is not necessary to close off the suction holes which do not contribute to holding the recording medium 114 by suction and there is no need to change the pattern of the suction holes in accordance with recording media 114 of a large variety of sizes.

The suction sheet 420 needs to have a thickness that prevents inward depression due to the suction pressure, and desirably it is thin so as to enable close contact with the main body section 356 (intermediate sheet 424) when wrapped about the main body section 356. For example, desirably, the thickness of a suction sheet 420 made of stainless steel is 0.1 mm to 0.5 mm, and a more desirable thickness thereof when using stainless steel is approximately 0.3 mm. If a material other than stainless steel is used, then a suitable thickness should be determined by taking account of the rigidity and flexibility of the material used.

It is preferable to arrange the suction holes 450 in the staggered matrix arrangement as in the present embodiment so as to dispose the plurality of suction holes 450 at high density. Of course, it is also possible to adopt an arrangement pattern other than a staggered matrix pattern for the arrangement of the suction holes 450.

In a state where the recording medium 114 is fixed on the main body section 356 (see FIG. 15), the amount of deformation of the recording medium 114 due to the suction pressure is greater in the axial direction than in the circumferential direction. Therefore, desirably, the suction holes 450 are formed with an elliptical or elongated oval shape having the major axis in the circumferential direction and the minor axis in the axial direction, in such a manner that the recording medium 114 deforms by an equal amount in the circumferential direction and in the axial direction.

Desirably, the ratio of "y/x" between the major axis length x and the minor axis length y of the suction holes 450 having an elongated hole shape is not smaller than 0.5 and not larger than 1.0, and more desirably, not smaller than 0.7 and not larger than 0.9.

In order to increase the opening ratio of the suction sheet 420, a desirable mode is one where the shape of the openings (the shape of the suction holes) is a polygonal shape, such as a hexagonal shape. More specifically, since the suction pressure can be represented by "(opening surface area)×(pressure per unit surface area)", then by increasing the opening ratio, it is possible further to increase the suction pressure. However, if the opening surface area becomes too large, then depression of the suction sheet 420 and depression of the recording medium 114 become a problem, and therefore it is desirable to adopt a structure which leaves boundary portions between adjacent suction holes, so as to guarantee the rigidity of the suction sheet 420.

Considering these conditions, a desirable shape for the suction holes is a hexagonal shape in which the length d of the diagonal (the longest diagonal) is approximately 1 mm. Moreover, if the suction holes have an angled (sharp angled) shape, then stress is concentrated in the corner sections and therefore it is desirable that the corners should be given a rounded shape.

A desirable mode is one in which air is blown onto the recording surface side of the recording medium 114 (the side opposite to the conveyance drum 300), so as to assist the fixing of the recording medium 114.

Next, the method of fixing the suction sheet 420 and the intermediate sheet 424 will be described.

Firstly, the suction sheet 420 is laid over the intermediate sheet 424 and wrapped about the main body section 356. By providing the suction sheet 420 and the intermediate sheet 424 with positional alignment marks and shapes, the two sheets can be aligned together in position, easily and accurately.

Thereupon, one fold structure of the suction sheet 420 and the fold structure of the intermediate sheet 424 are inserted into the gripping structure 432 of the main body section 356 and fixed thereby. By providing cutaway sections in the fold structure of the suction sheet 420 and the hold structure of the intermediate sheet 424, and providing projecting sections in the gripping structure 432 which fit together with the cutaway sections, it is possible to align the positions of the suction sheet 420, the intermediate sheet 424 and the main body section 356 easily and accurately, when the one fold structure of the suction sheet 420 and the fold structure of the intermediate sheet 424 are inserted into the gripping structure 432 of the main body section 356.

The other fold structure of the suction sheet 420 is attached to the tensioning mechanism 433 on the main body section 356, and tension is applied in the circumferential direction by the tensioning mechanism 433. The end portion of the intermediate sheet 424 on the side where the fold structure is not provided is gripped in close contact between the suction sheet 420 and the main body section 356.

Thus, it is possible to fix the suction sheet 420 and the intermediate sheet 424 in a state of close mutual contact about the curved circumferential surface 356A of the main body section 356.

In the present embodiment, a mode is described in which a portion of the vacuum flow channel is formed by combining two sheets (the suction sheet 420 and the intermediate sheet 424), but it is also possible to form the suction holes 450, the suction grooves 422 and the restrictor sections 434 in one sheet that serves both as the suction sheet 420 and the intermediate sheet 424. For example, it is possible to achieve the suction sheet 420 and the intermediate sheet 424 in a single sheet by processing the suction holes in one surface of the sheet and processing the suction grooves 422 and the restrictor sections 434 in the other surface.

Description of Conveyance of Recording Medium

Next, the conveyance of the recording medium in the conveyance drum 300 having the vacuum suction conveyance structure described above will be described in detail with reference to FIG. 21.

Figure 21:
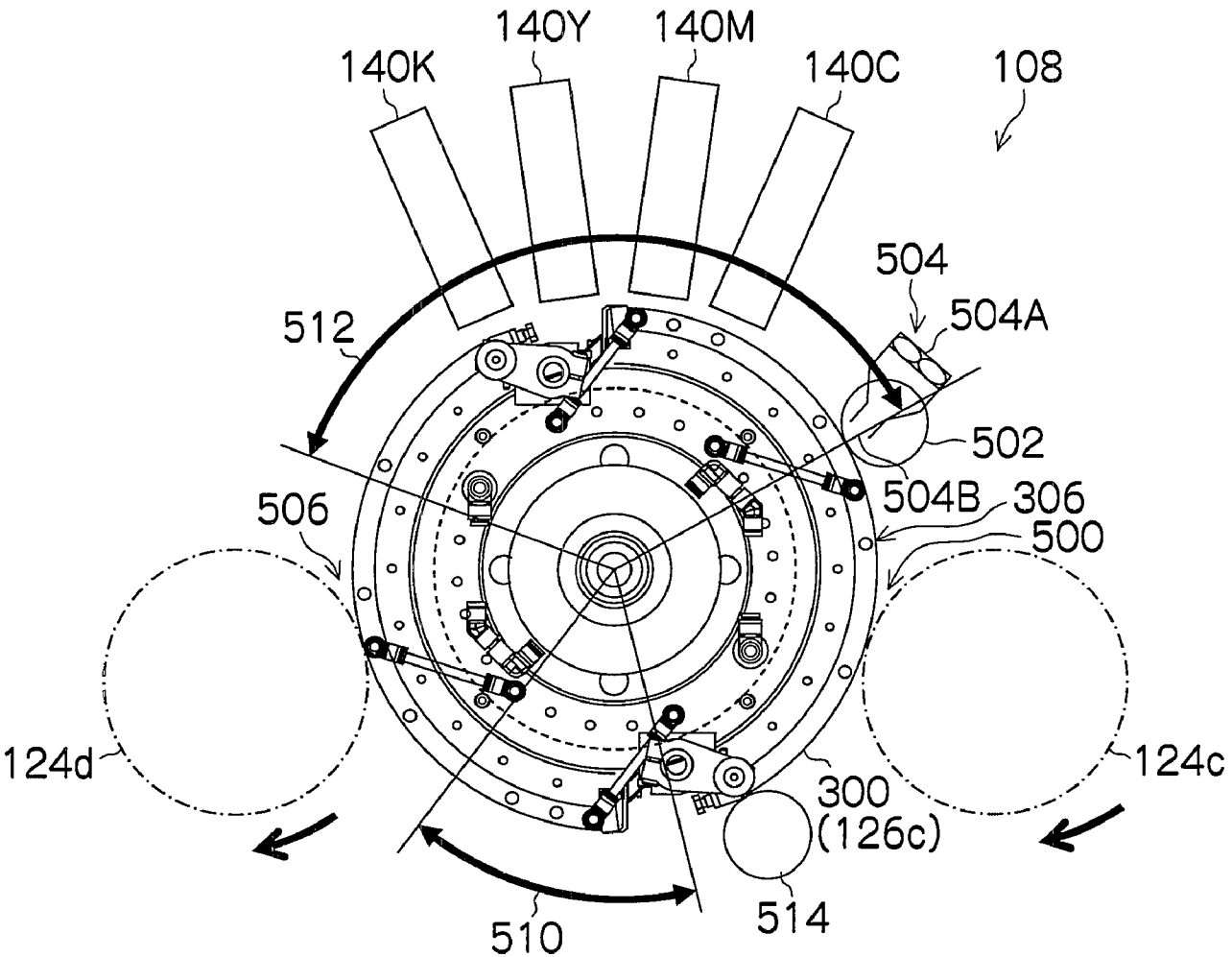
FIG. 21 is an explanatory drawing of the conveyance of a recording medium according to the embodiment of the present invention.

FIG. 21 is a schematic drawing of the conveyance drum 300 and the periphery of same; and corresponds to the print unit 108 in FIG. 1. Although FIG. 1 shows the mode in which individual heads are provided respectively for the seven colors of ink; in FIG. 21, in order to simplify the drawing, it is supposed that individual heads are provided respectively for four colors of ink (for example, CMYK). Moreover, although the pressure drum 126*c* in FIG. 1 has the structure in which recording medium end holding sections (recess sections) are provided in three locations (not shown in FIG. 1); in FIG. 21, it is explained as a drum having the structure of the conveyance drum 300, which has been described with reference to FIGS. 7 to 20.

The conveyance drum 300 (pressure drum 126*c*) shown in FIG. 21 holds, in the end holding section, the leading end of the recording medium held by the transfer drum 124*c* of the preceding stage (not shown in FIG. 21; see FIG. 1), which is transferred at a prescribed transfer position (supply position) 500, and furthermore the recording medium is conveyed in a prescribed conveyance direction (the counter-clockwise direction in FIG. 21) in a state of being fixed and held on the outer circumferential surface 306.

At the transfer position 500 of the recording medium, the mechanism which holds the recording medium on the transfer drum 124*c* is released, and the leading end of the recording medium is guided to the recess section 308 (310) of the conveyance drum 300 by a prescribed guide member and the leading end of the recording medium is held by the end holding section inside the recess section 308.

A paper pressing roller 502 is arranged in the direct vicinity of the transfer position 500 of the recording medium on the downstream side in terms of the conveyance direction, the recording medium is pressed against the outer circumferential surface 306 of the conveyance drum 300 by the paper pressing roller 502, and the recording medium makes tight contact with the outer circumferential surface 306 of the conveyance drum 300. In conjunction with or in place of the paper pressing roller 502, it is also possible to blow air onto the recording medium to cause the recording medium to make tight contact with the outer circumferential surface 306 of the conveyance drum 300. FIG. 21 shows an air blowing device 504 having an air flow generating unit 504A and a jet nozzle 504B.

After thereby causing the recording medium to make tight contact with the outer circumferential surface 306 of the conveyance drum 300, the recording medium is held by suction to the outer circumferential surface 306 of the conveyance drum 300 by the vacuum pressure described above, and the recording medium is conveyed to a printing region directly below the heads 140C, 140M, 140Y and 140K, without the medium lifting up at all from the outer circumferential surface 306 of the conveyance drum 300.

When a desired image has been formed on the recording medium by the color inks ejected from the heads 140C, 140M, 140Y and 140K, then the recording medium is conveyed to a transfer position (output position) 506 and transferred to the transfer drum 124*d*.

At the transfer position 506, the vacuum pressure applied to the recording medium is turned off, and the fixing and holding of the leading end of the recording medium is released, and the recording medium is transferred to the transfer drum 124*d* by means of the prescribed guide.

Description of Maintenance of Pressure Drum (Conveyance Drum)

As described above, the conveyance drum 300 further rotates after transferring the recording medium, and when the recording medium holding region arrives at a blowing region 510, compressed air is supplied to the vacuum flow channel, and air is blown out to the exterior from the suction holes in the outer circumferential surface 306 (see FIG. 16).

More specifically, the course of one revolution of the conveyance drum 300 includes a sucking region 512 where the suction sheet (see FIG. 15) is sucked, and the blowing region 510 where compressed air is supplied to the suction sheet so that foreign matter such as paper dust, ink mist and other dirt which has become attached to the suction sheet (and somewhat entering the intermediate sheet) during printing is discharged in the angular region where no recording medium is held on the outer circumferential surface 306.

In the vacuum channel shown in the present embodiment, since the vacuum holding performance of the recording medium declines markedly if foreign matter such as paper dust, ink mist or other dirt produced during printing enters the suction grooves (see FIGS. 15 and 19) or the restrictor sections, which are connected to the suction grooves (see FIGS. 17 and 19), giving rise to blockages; and by maintaining the interior of the suction grooves and the interior of the restrictor sections in a state where they are not blocked by foreign matter, it is possible to improve the reliability of fixing of the recording medium.

Furthermore, a desirable mode is one in which a cleaning roller 514 is arranged between the blowing region 510 and the sucking region 512, and the outer circumferential surface 306 of the conveyance drum 300 is cleaned by means of the cleaning roller 514. FIG. 21 shows a mode where the cleaning roller 514 is arranged on the downstream side of the blowing region 510; however, it is possible to arrange the cleaning roller 514 on the upstream side of the blowing region 510, and it is also possible to arrange two cleaning rollers on both the upstream side and the downstream side of the blowing region 510.

In the present embodiment, the vacuum flow channel for vacuum holding the recording medium also serve as the flow channel for the compressed air used to maintain the conveyance drum 300, and the switching structure is provided between the flow channel, and the vacuum pump and the compressor. By means of the switching structure, it is possible to selectively connect the flow channel to one of the vacuum pump and the compressor.

Moreover, it is also possible to connect a pressure generating device constituted so as to be selectively switchable between generating negative pressure and generating positive pressure, to the vacuum flow channel inside the conveyance drum 300.

Furthermore, it is also possible to adopt a mode in which the above-described sucking and blowing operations are switched between an image forming mode (during printing) and a maintenance mode (not during printing). More specifically, in the image forming mode, the suction sheet is sucked in the whole region of one revolution of the conveyance drum 300, and in the maintenance mode, compressed air is supplied to the suction sheet in the whole region of one revolution of the conveyance drum 300. In the maintenance mode, the heads 140C, 140M, 140Y and 140K are withdrawn to a prescribed withdrawn position.

The control of switching between sucking of the suction sheet and supplying compressed air to the suction sheet as described above is performed on the basis of control signals from the maintenance processing control unit 197 shown in FIG. 5. Moreover, it is desirable that the maintenance of the heads 140C, 140M, 140Y and 140K is carried out simultaneously when carrying out the above-described maintenance mode.

Further Example of Apparatus Composition

The image recording apparatuses 100 and 200 described above use the inkjet method; however, the present invention can also be applied to other recording systems such as a laser recording system. The present invention is particularly effective when applied to a high-NA optical system which performs high-precision recording using a small beam width, since the distance between the final lens and the recording medium is often equal to or less than several millimeters.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

a holding and conveyance device which has a round cylindrical shape and is rotatable about a rotational axis, the holding and conveyance device conveying a recording medium in a prescribed conveyance direction by rotating about the rotational axis while holding the recording medium on an outer circumferential surface of the holding and conveyance device, the holding and conveyance device having a recess section arranged in a direction parallel to the rotational axis at a prescribed position on the outer circumferential surface of the holding and conveyance device;

an end portion holding member which is arranged in the recess section and has an end portion holding surface by which at least one of a leading end portion and a trailing end portion of the recording medium held on the outer circumferential surface is held to an inner side relative to an image forming surface of the recording medium held on the outer circumferential surface;

a gripping member which is arranged in the recess section and grips the recording medium against the end portion holding surface; and an image forming device which forms an image on the recording medium held on the holding and conveyance device, wherein:

a radius of curvature of the end portion holding surface is smaller than a radius of the outer circumferential surface;

a tangential direction of the end portion holding surface at an end of the end portion holding surface on a side of the outer circumferential surface is substantially a same with a tangential direction of the outer circumferential surface at an end on a side of the end portion holding surface;

the end portion holding surface includes a curved surface section in connection with the end of the outer circumferential surface and a flat surface section in connection with an end of the curved surface section on a side opposite to the outer circumferential surface; and the gripping member is disposed at a position where the gripping member grips the at least one of the leading end portion and the trailing end portion of the recording medium onto the flat surface section.

2. The image forming apparatus as defined in claim 1, wherein an angular difference between the tangential direction of the end portion holding surface at the end of the end portion holding surface on the side of the outer circumferential surface and the tangential direction of the outer circumferential surface at the end on the side of the end portion holding surface is less than 5°.

3. The image forming apparatus as defined in claim 1, wherein the gripping member is disposed to an inner side relative to the image forming surface of the recording medium in a state where the at least one of the leading end portion and the trailing end portion of the recording medium is gripped.

4. The image forming apparatus as defined in claim 1, wherein:

the end portion holding surface includes a plurality of curved surface sections having radii of curvature different to each other; and each of the radii of curvature of the curved surface sections is smaller than the radius of the outer circumferential surface of the holding and conveyance device.

5. The image forming apparatus as defined in claim 1, wherein the radius of curvature of the end portion holding surface is not smaller than 50 mm.

6. The image forming apparatus as defined in claim 1, wherein:

the holding and conveyance device has a suction structure which holds the recording medium on the outer circumferential surface by suction; and the image forming apparatus further comprises a pressure generating device which applies a suction pressure to the recording medium through the suctioning structure.

7. The image forming apparatus as defined in claim 1, further comprising a pressing device which presses the recording medium against the outer circumferential surface of the holding conveyance device.

8. The image forming apparatus as defined in claim 1, wherein the image forming device includes a liquid ejection head having nozzles which eject liquid.

* * * * *